US005409808A

United States Patent [19]

Mizukawa et al.

[11] Patent Number: 5,409,808

[45] Date of Patent: Apr. 25, 1995

[54] SILVER HALIDE COLOR PHOTOGRAPHIC MATERIAL

[75] Inventors: Yuki Mizukawa; Hideaki Naruse; Toshiyuki Watanabe; Tadahisa Sato, all of Kanagawa, Japan

[73] Assignee: Fuji Photo Film Co., Ltd., Kanagawa, Japan

[21] Appl. No.: 17,261

[22] Filed: Feb. 12, 1993

[30] Foreign Application Priority Data

Feb. 13, 1992 [JP] Japan ..... 4-058827

[51] Int. Cl.[6] ..... G03C 7/38

[52] U.S. Cl. ..... 430/558; 430/387

[58] Field of Search ..... 430/558, 387

[56] References Cited

FOREIGN PATENT DOCUMENTS

| | | | |
|---|---|---|---|
| 0428902 | 5/1991 | European Pat. Off. | 430/558 |
| 2019849 | 1/1987 | Japan | 430/558 |
| 3284747 | 11/1991 | Japan | 430/558 |
| 96059 | 2/1992 | Japan . | |
| 52640 | 3/1992 | Japan . | |

*Primary Examiner*—Lee C. Wright

*Attorney, Agent, or Firm*—Birch, Stewart, Kolasch & Birch

[57] ABSTRACT

Disclosed is a silver halide color photographic material having at least one light-sensitive silver halide emulsion layer on a support and containing at least one coupler of formula (I):

(I)

where $R_1$ represents an alkyl group; $R_2$ and $R_3$ each represent a hydrogen atom, an alkyl group or an aryl group, provided that both $R_2$ and $R_3$ are not hydrogen atoms at the same time; $R_4$ and $R_5$ each represent an alkyl group; X represents a hydrogen atom or a substituent capable of splitting off by coupling with an oxidation product of a developing agent; Y represents a substituent; n represents 0 or 1; and m represents an integer of from 0 to 3. The material has excellent sensitivity and gradation and has improved storage stability, especially latent image stability.

7 Claims, No Drawings

SILVER HALIDE COLOR PHOTOGRAPHIC MATERIAL

FIELD OF THE INVENTION

The present invention relates to a silver halide color photographic material and to 1H-pyrazolo[1,5-b][1,2,4]triazole magenta couplers used in the material.

BACKGROUND OF THE INVENTION 1H-pyrazolo[1.5-b][1,2,4]triazole magenta couplers are disclosed in JP-A-59-171956 (the term "JP-A" as used herein means an "unexamined published Japanese patent application") and U.S. Pat. No. 4,540,654. These couplers are known to have excellent color reproducibility and give fast color images; they are also known to be easily produced. Various investigations have heretofore been made for improving the sensitivity and gradation of these couplers. For instance, couplers having a phenolic hydroxyl group in the molecule are disclosed in JP-A-61-65248 and U.S. Pat. No. 4,443,536; couplers having a sulfonamido group in the molecule are disclosed in JP-A-61-65246 and European Patent 176,804; couplers having two sulfonamido groups in the molecule are disclosed in JP-A-62-125349; and couplers having a sulfonyl group in the molecule are disclosed in JP-A-62-209460. However, silver halide photographic materials containing the couplers described in these patent publications have a problem in that their sensitivity lowers when they are stored for a long period of time. Silver halide photographic materials containing couplers described in JP-A-62-79451, U.S. Pat. No. 4,900,655 and JP-A-1-106055 where $R_5$ is a substituted phenyl group also have the same problem.

SUMMARY OF THE INVENTION

The object of the present invention is to provide a silver halide color photographic material having excellent sensitivity and gradation and also having excellent storage stability.

The object has been attained by a silver halide color photographic material containing a coupler of a general formula (I):

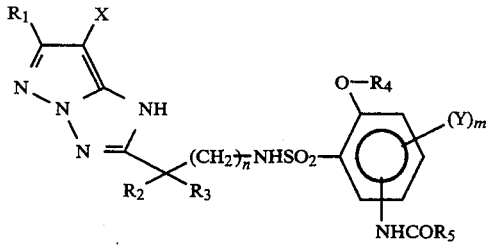

(I)

where $R_1$ represents an alkyl group; $R_2$ and $R_3$ each represent a hydrogen atom, an alkyl group or an aryl group, provided that both $R_2$ and $R_3$ are not hydrogen atoms at the same time; $R_4$ represents an alkyl group; $R_5$ represents an alkyl group; X represents a hydrogen atom or a substituent capable of splitting off by coupling with an oxidation product of a developing agent; Y represents a substituent; n represents 0 or 1; and m represents an integer of from 0 to 3.

DETAILED DESCRIPTION OF THE INVENTION

Couplers of formula (I) will be explained in more detail.

In formula (I), $R_1$ represents an alkyl group, which is a linear or branched, substituted or unsubstituted alkyl group. As substituents of the substituted alkyl group, mentioned are, for example, a halogen atom (e.g., chlorine, fluorine), an aryl group (e.g., phenyl, naphthyl, p-tolyl), a heterocyclic group (e.g., 4-pyridyl, 2-furyl), an alkoxy group (e.g,. methoxy, ethoxy, butoxy, dodecyloxy, isopropyloxy, t-butoxy), an aryloxy group (e.g., phenoxy, 2,4-di-t-amylphenoxy, p-t-octylphenoxy, 2-methoxyphenoxy), an alkylthio group (e.g., methylthio, ethylthio, octylthio, 2-ethylhexylthio, dodecylthio), an arylthio group (e.g., phenylthio, 2-butoxy-5-octylphenylthio), an acyl group (e.g., acetyl, pivaloyl, benzoyl), a carbamoyl group (e.g., N,N-diethylcarbamoyl, N-butylcarbamoyl, N-phenylcarbamoyl ), an amido group (e.g., acetamido, pivaloylamido, tetradecanamido, benzamido), an ureido group (e.g., N,N-diethylureido, N-phenylureido), a sulfonamido group (e.g., methanesulfonamido, p-toluenesulfonamido), an alkoxycarbonyl group (e.g., methoxycarbonyl, ethoxycarbonyl, butoxycarbonyl, isopropyloxycarbonyl, dodecyloxycarbonyl), and a cyano group.

Preferably, $R_1$ is an unsubstituted linear or branched alkyl group (e.g., $C_{1-8}$ alkyl); and most preferably, it is a methyl group or an ethyl group.

In formula (I), $R_2$ and $R_3$ each represent a hydrogen atom, an alkyl group or an aryl group. The alkyl group of $R_2$ and $R_3$ has the same meaning as that of the preceding alkyl group defined for $R_1$. The aryl group of $R_2$ and $R_3$ is a substituted or unsubstituted aryl group (e.g., phenyl). As possible substituents on the substituted aryl group, those defined for the substituted alkyl group of $R_1$ are referred to.

Preferably, at least one of $R_2$ and $R_3$ is a $C_{1-8}$alkyl group and is most preferably a methyl group.

In formula (I), $R_4$ represents an alkyl group, which is a linear or branched (e.g., $C_{1-12}$ alkyl), substituted or unsubstituted alkyl group. As substituents of the substituted alkyl group, those defined for the preceding substituted alkyl group of $R_1$ are referred to. More preferably, $R_4$ is represented by the following general formula (II):

$$-(CH_2)_2-(A)-R_6 \quad \text{(II)}$$

where A represents an oxygen atom, a nitrogen atom or a sulfur atom; and $R_6$ represents an alkyl group, an aryl group or an acyl group.

The group of formula (II) will be explained in more detail.

A is most preferably an oxygen atom.

$R_6$ represents an alkyl group, an aryl group or an acyl group. The alkyl group is a linear or branched, substituted or unsubstituted alkyl group (e.g., $C_{1-8}$alkyl). As substituents of the substituted alkyl group, those defined for the preceding substituted alkyl group of $R_1$ are referred to. The aryl group is a substituted or unsubstituted aryl group (e.g., phenyl). As substituents of the substituted aryl group, those defined for the preceding substituted alkyl group of $R_1$ are referred to. The acyl group includes, for example, acetylpropanoyl, butanoyl, t-butanoyl, cyclohexanoyl, 2-ethylhexanoyl, dodecanoyl, α-(2,4-di-t-amylphenoxy)hexanoyl groups.

Most preferably, $R_6$ is a methyl group, an ethyl group, a propyl group, an isopropyl group, a butyl group or a phenyl group.

In formula (I), $R_5$ represents an alkyl group, which is a linear or branched, substituted or unsubstituted alkyl group. As substituents for the substituted alkyl group, mentioned are, for example, a halogen atom (e.g., fluorine, chlorine), a hydroxyl group, a cyano group, an aryl group (e.g., phenyl, naphthyl), an alkoxy group (e.g., methoxy, ethoxy, propyloxy, butyloxy, 2-ethylhexyloxy, hexyloxy, octyloxy, dodecyloxy, hexadecyloxy, ethoxyethoxy, phenoxyethoxy, 4-methoxyphenoxyethoxy), an aryloxy group (e.g., phenoxy, 2,4-di-t-amylphenoxy, 4-methylphenoxy, 4-ethoxycarbonylphenoxy, 4-methoxyphenoxy, 4-ethoxyphenoxy), an alkylthio group (e.g., methylthio, ethylthio, propylthio, butylthio, octylthio, dodecylthio, hexadecylthio), an arylthio group (e.g., phenylthio, 2-pivaloylamidophenylthio, 2-butoxy-5-t-octylphenylthio, 4-dodecyloxyphenylthio), an acyl group (e.g., acetyl, benzoyl), an amido group (e.g., acetamido, butanamido, tetradecanamido, hexadecanamido, benzamido, 2-butoxybenzamido, 2-hexadecyloxybenzamido, 4-dodecyloxybenzamido, 4-t-butylbenzamido, α-(2,4-di-t-amylphenoxy)butanamido), a sulfonamido group (e.g., methanesulfonamido, ethanesulfonamido, octanesulfonamido, hexadecanesulfonamido, benzenesulfonamido, 4-methylbenzenesulfonamido, 4-dodecyloxybenzenesulfonamido, 2-octyloxy-5-t-octylbenzenesulfonamido), a carbamoyl group (e.g., N-methylcarbamoyl, N-ethylcarbamoyl, N-butylcarbamoyl, N-dodecylcarbamoyl, N-cyclohexylcarbamoyl, N,N-diethylcarbamoyl, N,N-diisopropylcarbamoyl, N,N-dibutylcarbamoyl, N-octadecyl-N-methylcarbamoyl, N-phenylcarbamoyl), a sulfamoyl group (e.g., N-ethylsulfamoyl, N-butylsulfamoyl, N-hexylsulfamoyl, N-dodecylsulfamoyl, N-cyclohexylsulfamoyl, N,N-diethylsulfamoyl, N,N-dibutylsulfamoyl), an ureido group (e.g., N-ethylureido, N-butylureido, N-hexadecylureido, N-phenylureido, N,N-dimethylureido, N,N-dibutylureido), an urethane group (e.g., methylurethane, ethylurethane, propylurethane, butylurethane, dodecylurethane, phenylurethane), an alkoxycarbonyl group (e.g., methoxycarbonyl, ethoxycarbonyl, propyloxycarbonyl, isopropyloxycarbonyl, butoxycarbonyl, dodecyloxycarbonyl, hexadecyloxycarbonyl), and a sulfonyl group (e.g., methylsulfonyl, ethylsulfonyl, butylsulfonyl, dodecylsulfonyl, hexadecylsulfonyl, octadecylsulfonyl).

Preferably, $R_5$ is an alkyl group having from 14 to 50 carbon atoms in total, and more preferably, it is an alkyl group having from 18 to 35 carbon atoms in total.

In formula (I), X represents a hydrogen atom or a substituent capable of splitting off by coupling with an oxidation product of a developing agent. The substituent is, for example, a halogen atom or a monovalent group having at least two atoms selected from the group consisting of C, N, O, S, P and H. Preferably, it is a hydrogen atom, a halogen atom, an alkoxy group, an aryloxy group, an alkylthio group, an arylthio group, a 3-membered to 10-membered heterocyclic group containing hetero atom(s) selected from the group consisting of O, N and/or S; or an acyloxy group.

More precisely, X is a hydrogen atom, a halogen atom (e.g., fluorine, chlorine, bromine), an alkoxy group (e.g., methoxy, ethoxy, methoxycarbonylmethoxy, methoxyethoxy), an aryloxy group (e.g., phenoxy, 4-methylphenoxy, 4-methoxycarbonylphenoxy, 4-t-octylphenoxy, 4-cyanophenoxy), an alkylthio group (e.g., dodecylthio, hexadecylthio, 1-ethoxycarbonyldodecylthio), an arylthio group (e.g., 2-pivaloylamidophenylthio, 2-butoxy-5-t-octylthio, 2-benzyloxycarbonylaminophenylthio), a heterocyclic group (e.g., 1-pyrazolyl, 4-methoxy-1-pyrazolyl, 4-chloro-1-pyrazolyl, 4-cyano-1-pyrazolyl, 4-acetylamino-1-pyrazolyl, 1-imidazolyl), or an acyloxy group (e.g., acetoxy, pivaloyloxy). Most preferably, X is a chlorine atom or an aryloxy group.

In formula (I), Y represents a substituent, which has the same meaning defined for the substituent of the substituted alkyl group of $R_1$.

n represents 0 or 1; and it is preferably 1. m represents an integer of from 0 to 3; and it is preferably 0.

In formula (I), the substituent —$NHCOR_5$ is preferably para-positioned to —$OR_4$.

Specific examples of couplers of formula (I) for use in the present invention are mentioned below, which, however, are not limitative.

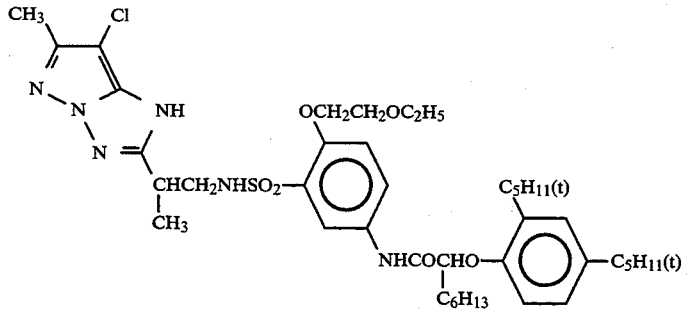

M-1

-continued
M-2
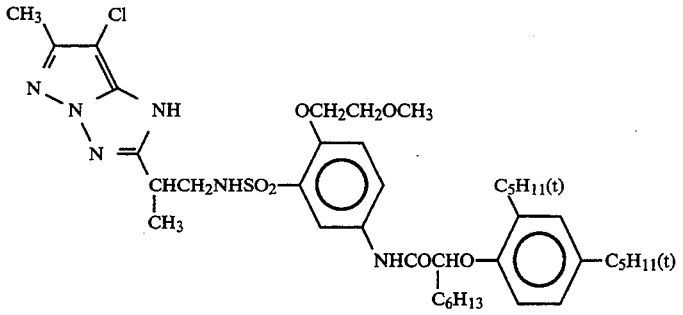
M-3
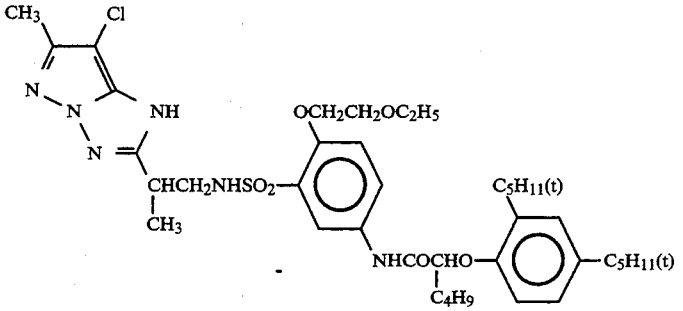
M-4
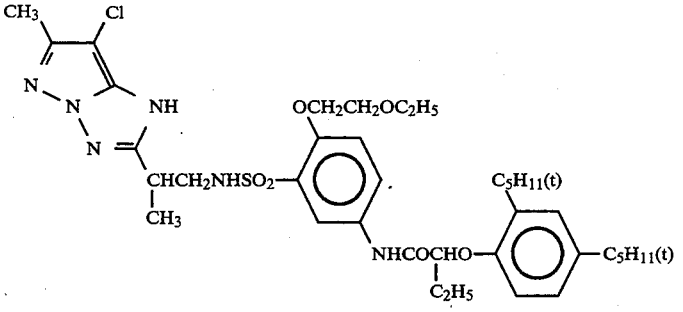
M-5
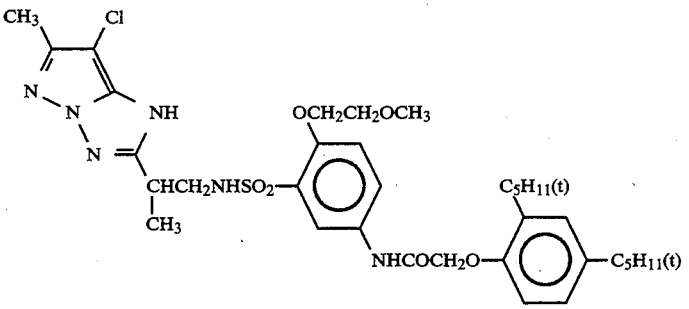
M-6
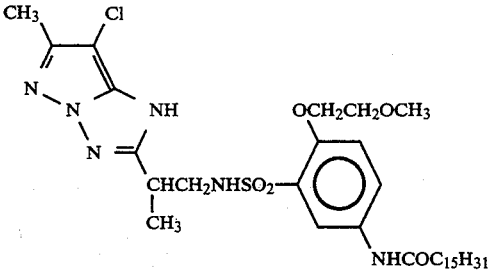

-continued
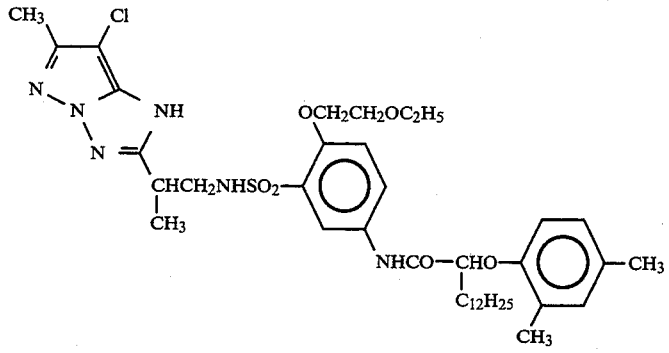
M-7
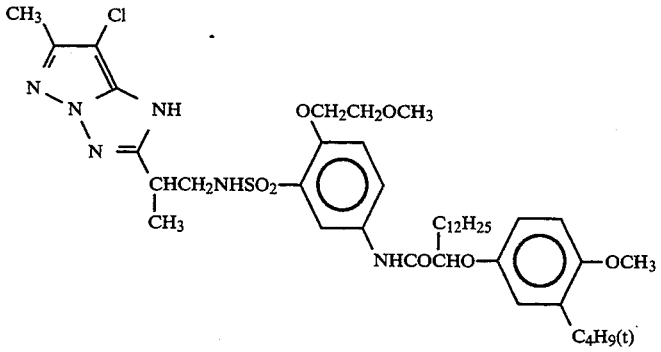
M-8
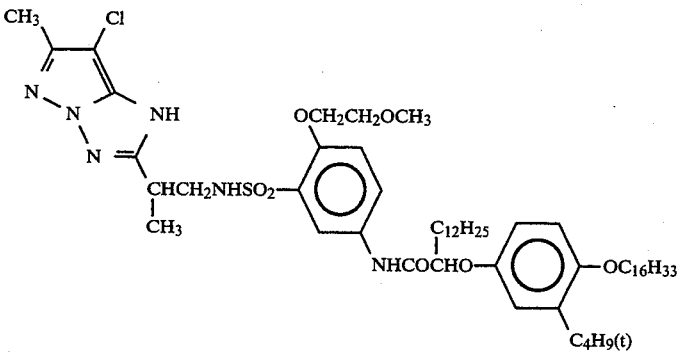
M-9
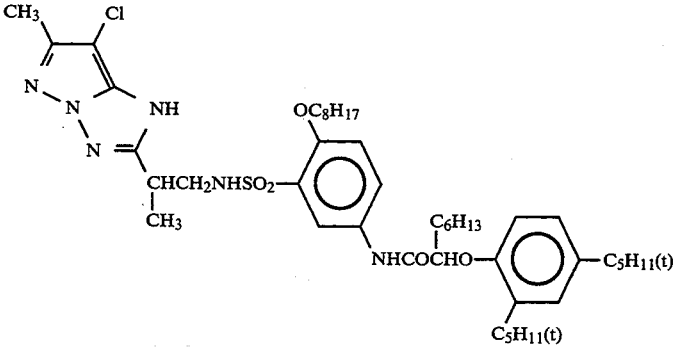
M-10

-continued
M-11
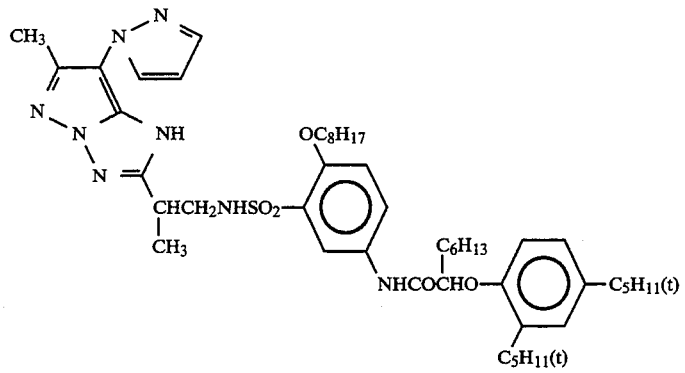
M-12
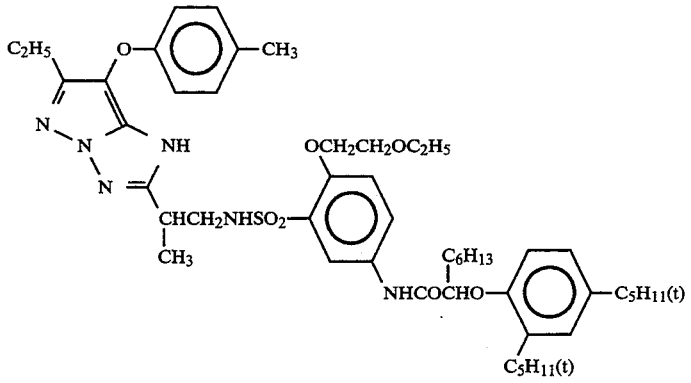
M-13
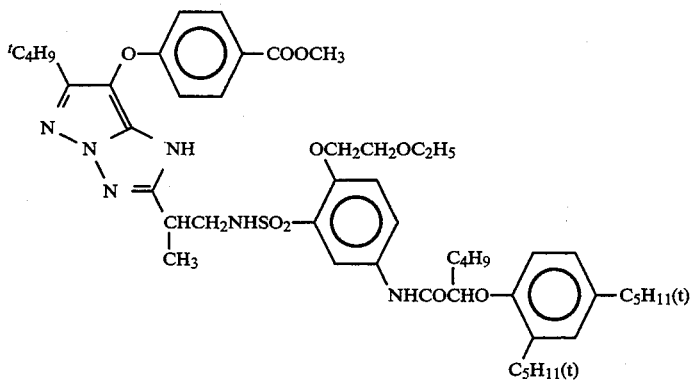
M-14
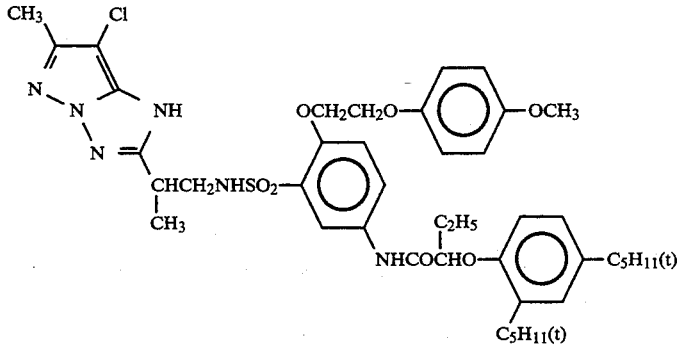

-continued
M-15
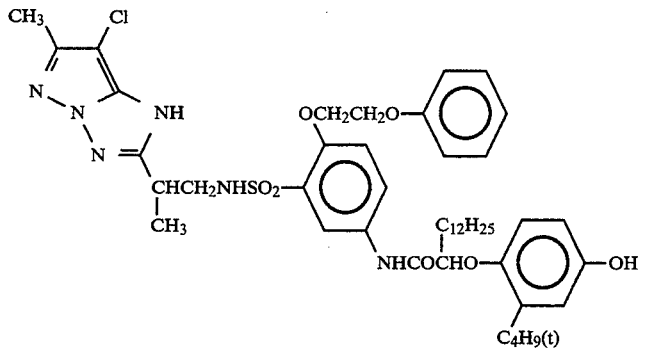
M-16
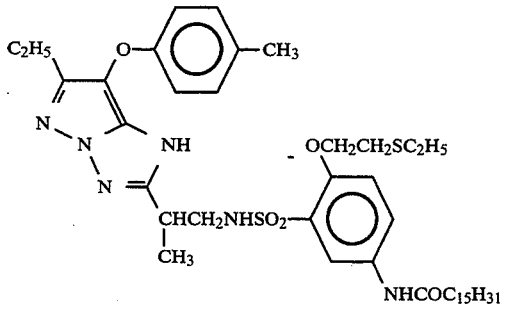
M-17
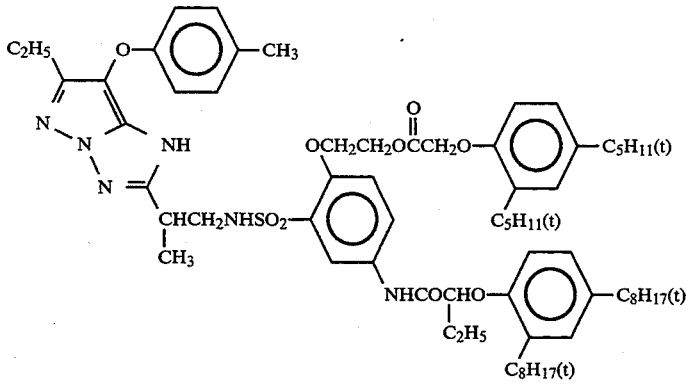
M-18
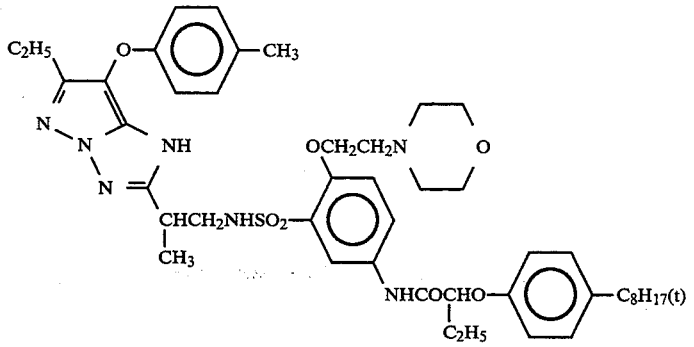

-continued
M-19
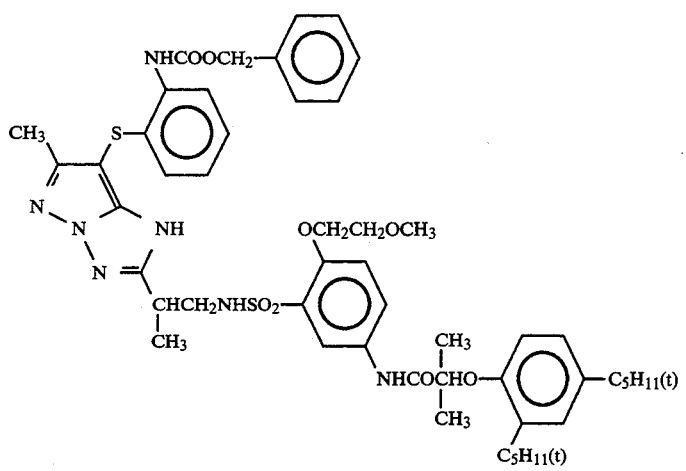
M-20
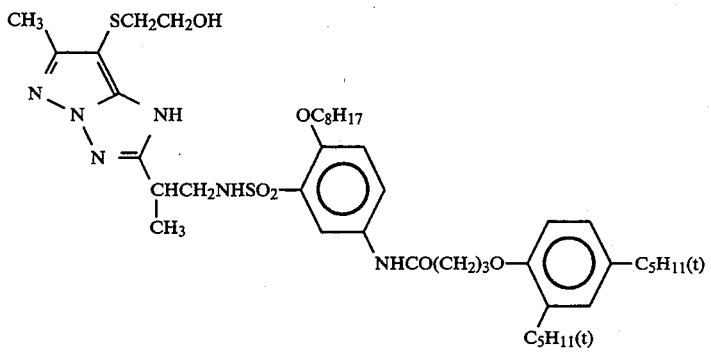
M-21
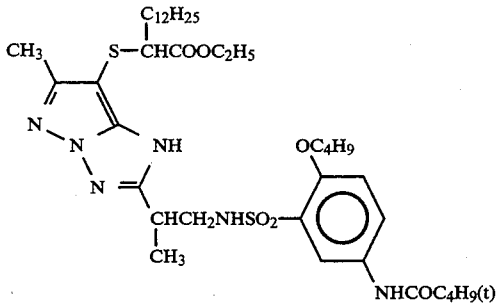
M-22
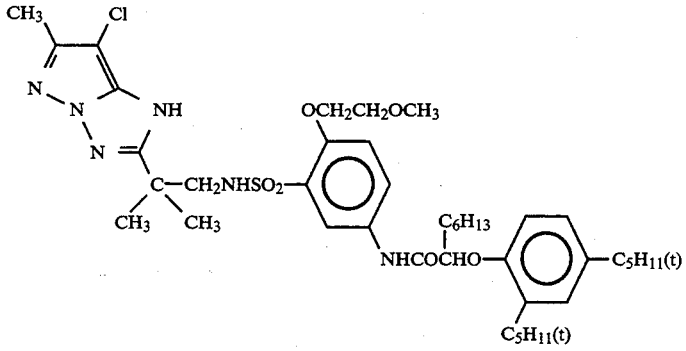

-continued
M-23
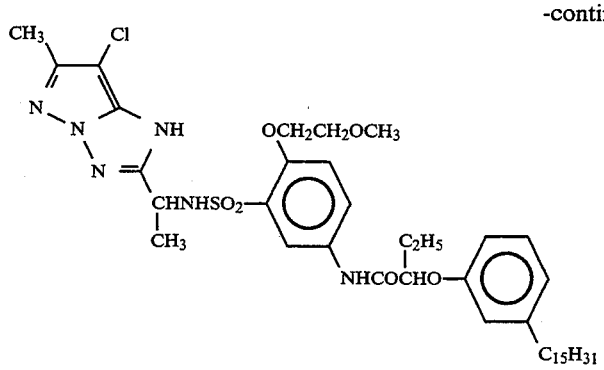
M-24
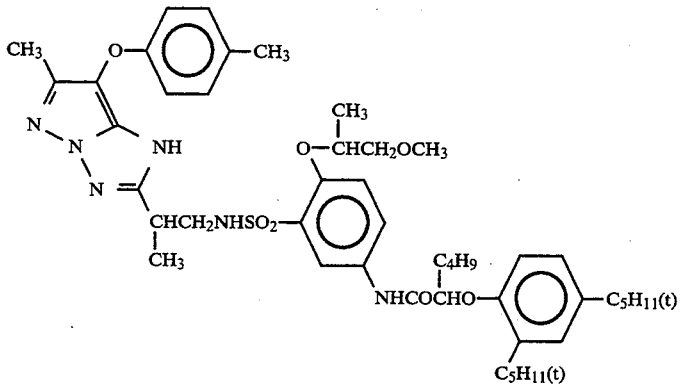
The general production methods for couplers of formula (I), which are used in the present invention is mentioned below.
Production of the 1H-pyrazolo[1,5-b][1,2,4]triazole skeleton is described in JP-A-60-197688 and JP-A-3-184980. For example, the skeleton may be produced in accordance with the following reaction scheme (A):
Reaction Scheme (A):
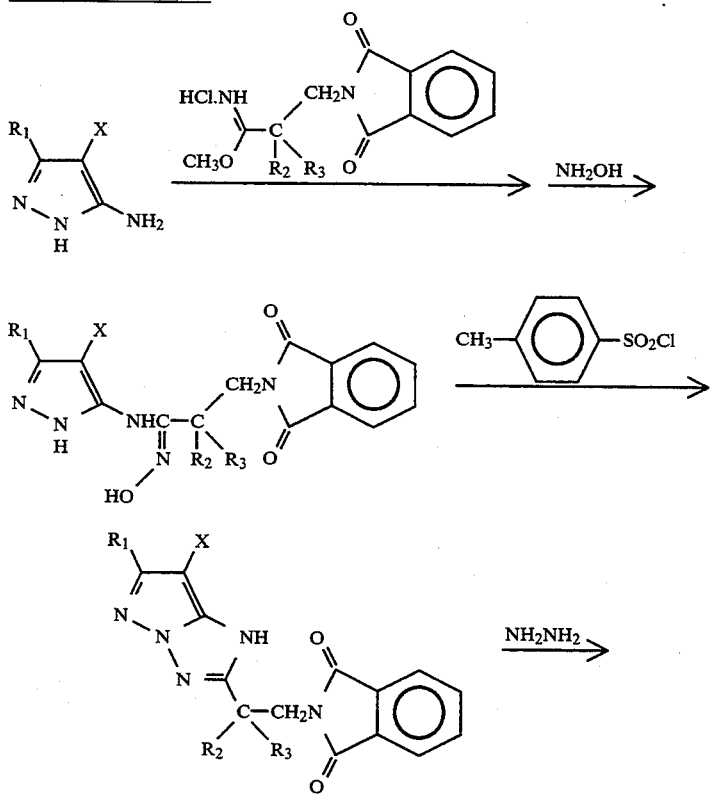

-continued

Reaction Scheme (A):

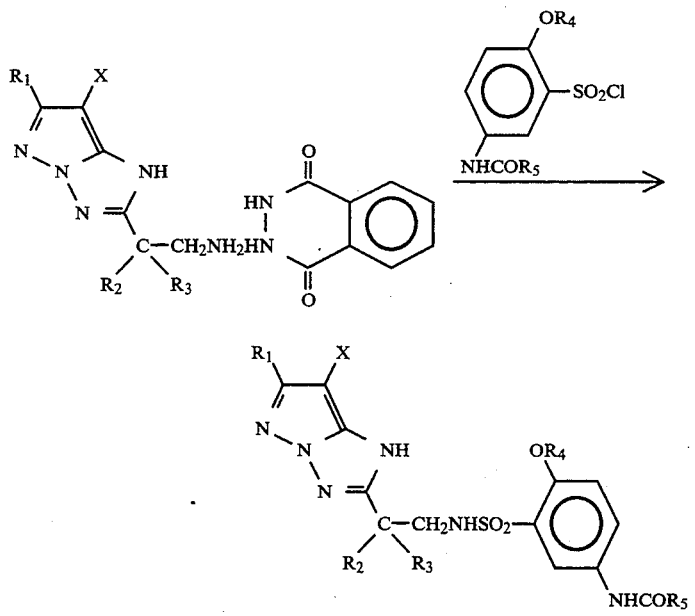

Couplers of formula (I) where the split-off group is bonded to the formula via an oxygen atom may be produced by first preparing 2-acyl-2-aryloxyacetonitriles by the method described in JP-A-2-300155 followed by applying them to the process mentioned above. Precisely, they may be produced, for example, in accordance with the following reaction scheme (B):

Reaction Scheme (B):

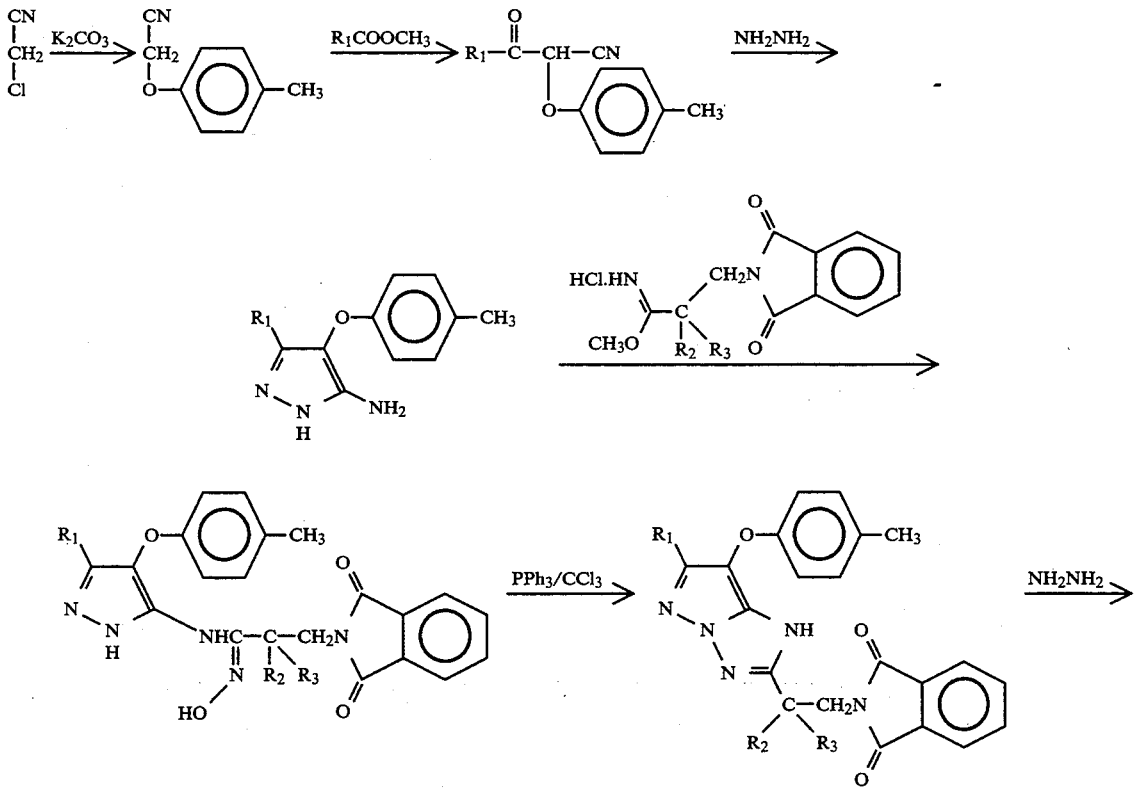

Reaction Scheme (B):

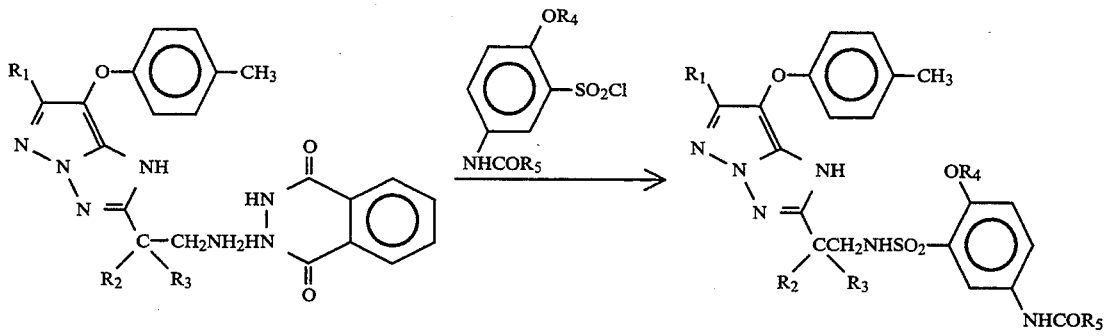

Introduction of an N-heterocyclic group is described in JP-A-2-59584. Precisely, N-heterocyclic group-containing couplers of formula (I) are produced, for example, in accordance with the following reaction scheme (C):

Reaction Scheme (C):

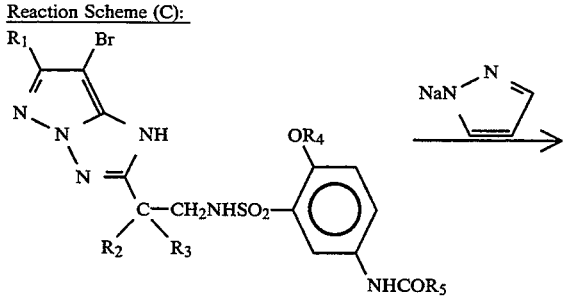

-continued

Reaction Scheme (C):

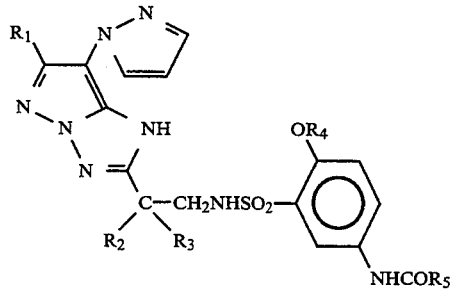

(The starting compounds are produced in accordance with the preceding reaction scheme (A).)

For production of couplers of formula (I) in which the split-off group is bonded to the formula via a sulfur atom, the method described in U.S. Pat. No. 3,227,554 is referred to. They may also be produced by reacting a coupler having a halogen atom (e.g., chlorine, bromine) at the coupling-active position and a mercaptan compound in the presence of a base.

Examples of production of couplers of formula (I) are mentioned below.

PRODUCTION EXAMPLE 1

Production of Coupler M-1

Coupler M-1 is produced in accordance with the following reaction scheme (D):

Reaction Scheme (D):

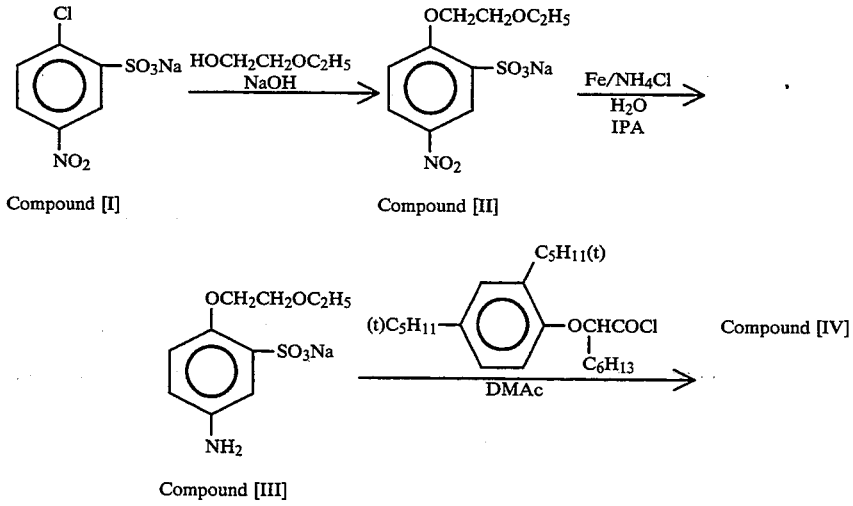

-continued

Reaction Scheme (D):

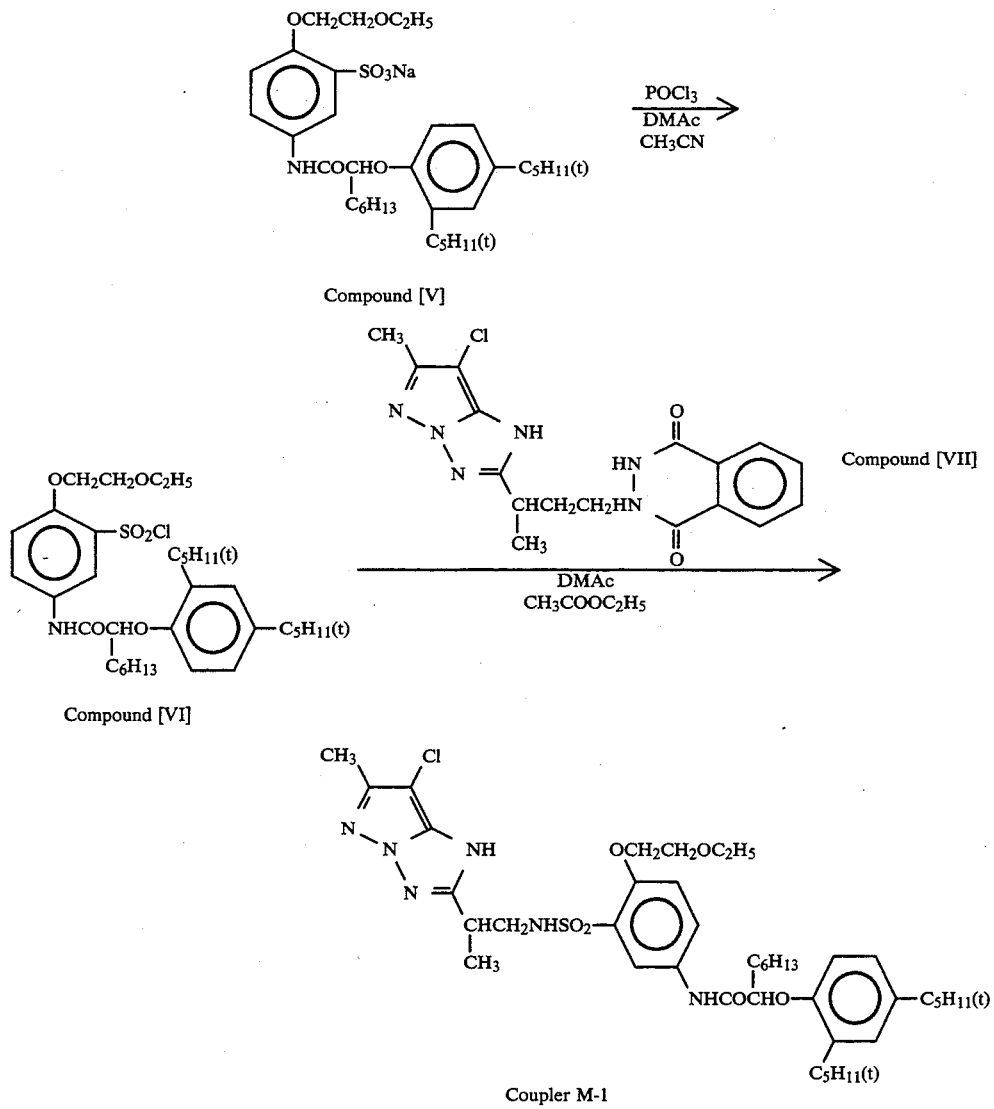

1000 ml of ethylene glycol monoethyl ether and 54 g of sodium hydroxide were added to 311 g of sodium 2-chloro-5-nitrobenzenesulfonate (compound (I)) and stirred under heat at 75° to 80° C. After stirred under heat for 3 hours, the resulting mixture was cooled to 50° C., and 50 ml of water and 20 ml of concentrated hydrochloric acid were added thereto. After further stirring, the insoluble substances were removed by filtration.

The filtrate was gradually and dropwise added to a hot liquid comprising 320 g of reduced iron, 32 g of ammonium chloride and 200 ml of water. After the addition, the liquid mixture was stirred under heat for about 3 hours. The reaction liquid was then filtered under reduced pressure while heating to remove the insoluble substances therefrom. The filtrate was concentrated under reduced pressure to precipitate crystals. 500 ml of ethanol was added to the residue so that the crystals were dispersed. They were taken out by filtration to obtain 182 g (53.5%) of sodium 5-amino-2-(2-ethoxyethoxy)benzenesulfonate (compound (III)); the compound had a melting point of 230° C. or higher.

550 ml of DMAc was added to 182 g of compound (III) obtained above and stirred while cooling with water. To the resulting solution was dropwise added 216 g of 2-(2,4-di-t-amylphenoxy)octanoic acid chloride (compound (IV)). After the addition, 49 ml of pyridine was dropwise added thereto. The resulting mixture was stirred for 2 hours while cooling with water, and 1000 ml of ethyl acetate and 1500 ml of water were added thereto. The aqueous layer was removed, and the remaining ethyl acetate phase was washed three times with a saline solution. The ethyl acetate phase was then dried with anhydrous magnesium sulfate, and ethyl acetate was removed therefrom by distillation under reduced pressure. Thus, compound (V) was obtained.

400 ml of DMAc and 500 ml of acetonitrile were added to 400 g of compound (V) obtained above and stirred at room temperature. To the resulting solution was gradually and dropwise added 220 ml of phosphorus oxychloride. After the addition, the mixture was heated up to 40° to 50° C. and stirred for 2 hours with heating. Thereafter, the reaction liquid was gradually poured into 1 kg of ice with stirring. The separated oily product was extracted with 1000 ml of ethyl acetate.

The ethyl acetate extract was washed with a saline solution and dried with anhydrous magnesium sulfate. Ethyl acetate was removed from it by distillation under reduced pressure, and 306 g (74.7%) of the sulfonic acid chloride product (compound (VI)) was obtained as an oil. Compound (VI) had the following physical data.

Proton NMR Spectrum ($CDCl_3$) δ(ppm) (multiplicity, integral values): 8.0–7.83 (m, 3H), 7.25 (d, 1H), 7.2–7.0 (m, 2H), 6.65 (d, 1H), 4.69 (t, 1H), 4.30 (t, 2H), 3,87 (t, 2H), 3.63 (q, 2H), 2.20–0.55 (m, 38H).

300 ml of DMAc and 600 ml of ethyl acetate were added to 165.5 g of the amine (compound (VII)) as obtained by the method described in JP-A-60-197688, and stirred while cooling with ice. To the solution was dropwise added 255 g of the sulfonic acid chloride (compound (VI)) obtained above. After the addition, the mixture was stirred for 30 minutes, and 62.8 ml of triethylamine was added thereto. After the addition, the mixture was stirred for 4 hours. Then the solution were added 10 ml of hydrochloric acid and 1000 ml of water, and this mixture was stirred for 30 minutes before the insoluble substances were removed therefrom by filtration under reduced pressure. The filtrate was extracted with 500 ml of ethyl acetate. The ethyl acetate extract was washed three times with a saline solution and then stirred with anhydrous magnesium sulfate. Ethyl acetate was removed from the extract by distillation under reduced pressure, and 2000 ml of n-hexane and 150 ml of ethyl acetate were added to the residue to precipitate crystals. The crystals were taken out by filtration and dried to obtain 202 g (56.3 %) of coupler (M-1), which had a melting point of 105° to 106° C. The compound was obtained as a mixture of diastereomers, and had the following physical data.

Proton NMR Spectrum ($CDCl_3$) δ(ppm) (multiplicity, integral values): 10.75 (s, 0.7H), 10.65 (s, 0.3H), 8.0 (s, 0.7H), 7.96 (s, 0.3H), 7.70 (d, d, 1H), 7.30–6.95 (m, 3H), 6.87–6.18 (m, 2H), 6.38 (d, 0.7H), 6.31 (d, 0.3H), 4.86–4.70 (m, 1H), 4.10–3.20 (m, 9H), 2.31 (s, 3H), 2.21–2.03 (m, 2H), 1.94 (q, 2H), 1.8–1.10 (m, 28H), 1,89 (t, 3H), 0.75–0.55 (m, 6H).

PRODUCTION EXAMPLES 2 TO 11

Couplers (M-2) to (M-12) were produced in the same manner as provided in Production Example 1. NMR data of these couplers are shown in Tables 1 and 2 below.

TABLE 1

| Coupler No. | m.p. (°C.) | Proton NMR δ (ppm) (multiplicity, integral values) |
|---|---|---|
| M-2 | 118~121 | ($CDCl_3$), 10.75(S, 0.7H), 10.70(S, 0.3H), 8.0(S, 0.7H), 7.94(S, 0.3H), 7.72(d.d, 1H), 7.35~7.00 (m, 3H), 6.70~6.65(m, 2H), 6.42(d, 0.7H), 6.38(d, 0.3H), 4.87~4.70(m, 1H), 4.08~3.60(m, 4H), 3.50(S, 3H), 3.45~3.22(m, 3H), 2.33(S, 3H), 2.22~2.03(m, 2H), 1.93(q, 2H), 1.81~1.10(m, 25H), 0.90(t, 3H), 0.69(t, 6H) |
| M-3 | 107~110 | ($CDCl_3$) 10.74(S, 0.7H), 10.67(S, 0.3H), 8.02(S, 0.7H), 7.94(S, 0.3H), 7.72(d.d, 1H), 7.33~6.95 (m, 3H), 6.33(t, 1H), 6.26(d, (1H), 6.37((d, 0.7H), 6.32(d, 0.3H), 4.88~4.72(m, 1H), 4.10~3.23 (m, 9H), 2.33(S, 3H), 2.23~2.03(m, 2H), 1.95(q, 2H), 1.79~1.11(m, 24H), 0.98(t, 3H), 0.69(t, 6H) |
| M-4 | 184~186 | ($CDCl_3$) 10.75(S, 0.6H), 10.68(S, 0.4H), 8.03(S, 0.6H), 7.95(S, 0.4H), 7.70(d.d, 1H), 7.31~6.97 (m, 3H), 6.82(t, 1H), 6.76(d, 1H), 6.39(d, 0.6H), 6.34(d, 0.4H), 4.87~4.70(m, 1H), 4.09~3.20 (m, 9H) 2.30~2.08(m, 2H), 1.95(q, 2H), 1.78~1.10(m, 26H), 0.69(t, 6H) |
| M-5 | 110~116 | ($CDCl_3$) 10.72(S, 1H), 8.87(S, 1H), 7.89(d, 1H), 7.41(d.d, 1H), 7.27(S, 1H), 7.19(d.d, 1H), 6.83(d, 1H), 6.69(t, 1H), 6.58(d, 1H), 4.73(S, 2H), 4.18~3.65(m, 4H), 3.49(S, 3H), 3.47~3.20(m, 3H), 2.34(S, 3H), 1.90(q, 2H), 1.64(q, 2H), 1.45(S, 6H), 1.28(d, 9H), 0.71(t, 6H) |
| M-6 | 121~122 | ($CDCl_3$) 10.93(S, 1H), 7.66~7.55(m, 2H), 7.32(d.d, 1H), 6.70(t, 1H), 6.49(d, 1H), 4.07~3.62(m, 4 H), 3.50(S, 3H), 3.48~3.17(m, 3H), 2.45(t, 2H), 2.32(S, 3H), 1.36~1.63(m, 2H), 1.54~1.10(m, 27H), 0.88(t, 3H) |

TABLE 2

| Coupler No. | m.p. (°C.) | Proton NMR δ (ppm) (multiplicity, integral values) |
|---|---|---|
| M-8 | vitreous | ($CDCl_3$) 10.80(S, 0.5H), 10.71(S, 0.5H), 8.37(S, 0.5H), 8.32(S, 0.5H), 7.72(d.d, 1H), 7.40~7.18 (m, 1H), 6.98(t, 1H), 6.88~6.64(m, 3H), 6.43(d.d, 1H), 4.72~4.55(m, 1H), 4.09~3.62(m, 7H), 3.55~3.20(m, 6H), 2.32(S, 3H), 2.14~1.93(m, 2H), 1.67~1.50(m, 2H), 1.48~1.0(m, 30H), 0.88 (t, 3H) |
| M-9 | vitreous | ($CDCl_3$) 10.79(S, 0.5H), 10.69(S, 0.5H), 8.38(S, 0.5H), 8.32(S, 0.5H), 7.72(d.d, 1H), 7.39~7.20 (m, 1H), 7.00(t, 1H), 6.86~6.65(m, 3H), 6.40(d.d, 1H), 4.75~4.55(m, 1H), 4.09~3.60(m, 6H), 3.50(S, 1.5H), 3.49(S, 1.5H), 3.45~3.20(m, 3H), 2.34(S, 3H), 2.13~1.74(m, 4H), 1.65~1.05(m, 58H), 0.89(t, 6H) |
| M-10 | 92~98 | ($CDCl_3$) 10.74(S, 0.5H), 10.65(S, 0.5H), 8.03(S, 0.5H), 7.90(S, 0.5H), 7.66(d.d, 1H), 7.33~7.05 (m, 3H), 6.93~6.70(m, 1H), 6.25(d, 0.5H), 6.20(d, 0.5H), 5.65(t, 1H), 4.85(t, 0.5H), 4.26(t, 0.5 H), 3.80~3.13(m, 5H), 2.35(S, 3H), 2.23~1.10(m, 4H), 1.0~0.77(m, 6H), 0.76~0.57(m, 6H) |
| M-11 | vitreous | ($CDCl_3$) 11.26(S, 0.5H), 11.19(S, 0.5H), 7.89(S, 1H), 7.68~7.50(m, 3H), 7.30~7.10(m, 3H), 6.75~6.36(m, 3H), 5.63(t, 1H), 4.76~4.63(m, 1H), 3.90~3.03(m, 5H), 2.37(S, 3H), 2.15~1.06(m, 41H), 1.03~0.79(m, 6H), 0.76~0.57(m, 6H) |
| M-12 | 100~102 | ($CDCl_3$) 10.19(S, 0.5H), 10.13(S, 0.5H), 7.92(S, 0.5H), 7.90(S, 0.5H), 7.68(d.d, 1H), 7.38~7.20 (m, 1H), 7.20~7.0(m, 4H), 6.90~6.77(m, 2H), 6.70~6.52(m, 3H), 4.70~4.50(m, 1H), 4.10~3.06 (m, 9H), 2.62(q, 2H), 2.29(S, 3H), 2.08~1.14(m, 35H), 0.90(t, 3H), 0.78~0.58(m, 6H) |

The photographic material of the present invention is not specifically defined, provided that it has at least one blue-sensitive silver halide emulsion layer, at least one green-sensitive silver halide emulsion layer and at least one red-sensitive silver halide emulsion layer on a support. In the material, the number of the silver halide emulsion layers and non-light-sensitive layers as well as the order of the layers on the support is not specifically defined. As one typical example, there is mentioned a silver halide color photographic material having plural light-sensitive layer units each composed of plural silver halide emulsion layers each having a substantially same color-sensitivity but having a different sensitivity degree. The respective light-sensitive layers are unit light-sensitive layers each having a color-sensitivity to anyone of blue light, green light and red light. In such a multi-layer silver halide color photographic material, in general, the order of the light-sensitive layer units to be on the support comprises a red-sensitive layer unit, a green-sensitive layer unit and a blue-sensitive layer unit as formed on the support in this order. As the case may be, however, the order may be opposite to the above-mentioned one, in accordance with the object of the photographic material. As still another embodiment, a different color-sensitive layer may be sandwiched between two other layers, including the same color-sensitive layers described above.

various non-light-sensitive layers such as an interlayer may be provided between the above-mentioned silver halide light-sensitive layers, or on or below the uppermost layer or lowermost layer thereof.

Such an interlayer may contain various couplers and DIR compounds described in JP-A-61-43748, JP-A-59-113438, JP-A-59-113440, JP-A-61-20037 and JP-A-61-20038, and it may also contain conventional color mixing preventing agents.

As the constitution of the plural silver halide emulsions which constitute the respective light-sensitive layer units, preferred is a two-layered constitution composed of a high-sensitivity emulsion layer and a low-sensitivity emulsion layer as described in German Patent 1,121,470 and British Patent 923,045. In general, it is preferred that the plural light-sensitive layers are arranged on the support in such a way that the sensitivity degree of the layers gradually decreases in the direction of the support. In such an embodiment, a non-light-sensitive layer may be provided between the plural silver halide emulsion layers. As another embodiment, a low-sensitivity emulsion layer is formed at a distance from the support and a high-sensitivity emulsion layer is formed near the support, as described in JP-A-57-112751, JP-A-62-200350, JP-A-62-206541, and JP-A-62-206543.

As specific examples of the layer constitution on the support, there are mentioned an order of low-sensitivity blue-sensitive layer (BL)/high-sensitivity blue-sensitive layer (BH)/high-sensitivity green-sensitive layer (GH)/low-sensitivity green-sensitive layer (GL)/high-sensitivity red-sensitive layer (RH)/low-sensitivity red-sensitive layer (RL) from the most distant from the support; and an order of BH/BL/GL/GH/RH/RL; and an order of BH/BL/GH/GL/RL/RH.

As other examples, there are mentioned an order of blue-sensitive layer/GH/RH/GL/RL from the most distant side from the support, as described in JP-B-55-34932; and an order of blue-sensitive layer/GL/RL/GH/RH from the most distant side from the support, as described in JP-A-56-25738 and JP-A-62-63936.

As a further example, there is mentioned a three-layer unit constitution as described in JP-B-49-15495, where the uppermost layer is a highest-sensitivity silver halide emulsion layer, the intermediate layer is a silver halide emulsion layer having a lower sensitivity than the uppermost layer, and the lowermost layer is a silver halide emulsion layer having a still lower sensitivity than the intermediate layer. That is, in the layer constitution of this type, the sensitivity degree of each emulsion layer is gradually lowered as one proceeds in the direction of the support. Even in the three-layer constitution of the type, each of the same color-sensitivity layers may be composed of three layers of middle-sensitivity emulsion layer/high-sensitivity emulsion layer/low-sensitivity emulsion layer as formed in this order from the most distant side from the support, as described in JP-A-59-202464.

As still other examples of the layer constitution of the photographic material of the present invention, there are mentioned an order of high-sensitivity emulsion layer/low-sensitivity emulsion layer/middle-sensitivity emulsion layer/, and an order of low-sensitivity emulsion layer/middle-sensitivity emulsion layer/high-sensitivity emulsion layer. Where the photographic material of the invention has four or more layers, the layer constitution thereof may be varied in accordance with the manner mentioned above.

In order to improve the color reproducibility, it is desired to provide a doner layer (CL) which has an interlayer effect and which has a different color sensitivity distribution from that of the essential light-sensitive layers of BL, GL and RL, adjacent to or near to the essential light-sensitive layers, in the manner described in U.S. Pat. Nos. 4,663,271, 4,705,744 and 4,707,436 and JP-A-62-160448 and JP-A-63-89850.

As mentioned above, various layer constitutions and arrangements may be selected in accordance with the object of the photographic material of the invention.

The silver halide to be preferably in the photographic emulsion layer of constituting the photographic material of the present invention is silver iodobromide, silver iodochloride or silver iodochlorobromide having a silver iodide content of about 30 mol % or less. Especially preferred is a silver iodobromide or silver iodochlorobromide having a silver iodide content of from about 2 mol % to about 10 mol %.

The silver halide grains to be in the photographic emulsion of constituting the photographic material of the present invention may be regular crystalline ones such as cubic, octahedral or tetradecahedral grains, or irregular crystalline ones such as spherical or tabular grains, or irregular crystalline ones having a crystal defect such as a twin plane, or composite crystalline ones composed of the above-mentioned regular and-irregular crystalline forms.

Regarding the grain size of the silver halide grains, the grains may be fine grains having a small grain size of about 0.2 micron or less or may be large ones having a large grain size of up to about 10 microns as the diameter of the projected area. The emulsion of the grains may be either a polydispersed emulsion or a monodispersed emulsion.

The silver halide photographic emulsions to be used in the present invention may be prepared by various methods, for example, those described in Research Disclosure (RD) No. 17643 (December, 1978), pages 22 to 23 (I. Emulsion Preparation and Types); RD No. 18716 (November, 1979), pages 648; RD No. 307105 (November 1989) pages 863 to 865; P. Glafkides, *Chimie et Physique Photographique* (published by Paul Montel, 1967); G. F. Duffin, *Photographic Emulsion Chemistry* (published by Focal Press, 1966); and V. L. Zelikman et al, *Making and Coating Photographic Emulsion* (published by Focal Press, 1964).

Monodispersed emulsions as described in U.S. Pat. Nos. 3,574,628 and 3,655,394 and British Patent 1,413,748 are also preferably used in the present invention.

Additionally, tabular grains having an aspect ratio of about 3 or more may also be used in the present invention. Such tabular grains may easily be prepared in accordance with various methods, for example, as described in Gutoff, *Photographic Science and Engineering*, Vol. 14, pages 248 to 257 (1970); and U.S. Pat. Nos. 4,434,226, 4,414,310, 4,430,048, 4,439,520 and British Patent 2,112,157.

Regarding the crystal structure of the silver halide grains contained in the emulsions of the invention, the grains may have the same halogen composition throughout the whole grain, or they may have different halogen compositions between the inside part and the outside part of one grain, or they may have a layered structure. Further, the grains may have different halogen compositions as conjugated by epitaxial bond, or they may have other components than silver halides, such as silver rhodanide or lead oxide, as conjugated with the silver halide matrix. Additionally, a mixture of various grains of different crystalline forms may be employed in the present invention.

The above-mentioned emulsions for use in the present invention may be either 1) surface latent image type ones capable of forming latent images essentially on the surfaces of the grains, or 2) internal latent image type ones capable of forming latent images essentially in the insides of them, or 3) they may also be surface/inside latent image type ones capable of forming latent images both on the surfaces of the grains and in the insides of them. In any event, the emulsions utilized should be negative emulsions. As internal latent image type emulsions, they may be internal latent image type core/shell emulsions as described in JP-A-63-264740. A method of preparing such internal latent image type core/shell emulsions is described in JP-A-59-133542. The thickness of the shell of the emulsion grains of this type varies, depending upon the way of developing them, and is preferably from 3 to 40 nm, especially preferably from 5 to 20 nm.

The emulsions for use in the invention are generally physically ripened, chemically ripened and/or spectral-sensitized. Additives to be used in such a ripening or sensitizing step are described in Research Disclosure Nos. 17643, 18716 and 307105, and the related descriptions in these references are shown in the table mentioned below.

In the photographic material of the present invention, two or more emulsions which are different from one another in at least one characteristic of the light-sensitive silver halide grains constituting them, which is selected from the grain size, the grain size distribution, the halogen composition, the shape and the sensitivity of the grains, can be incorporated into one and the same layer.

Surface-fogged silver halide grains as described in U.S. Pat. No. 4,082,553; inside-fogged silver halide grains as described in U.S. Pat. No. 4,626,498 and JP-A-59-214852; as well as colloidal silver may preferably be used in light-sensitive silver halide emulsion layers and/or substantially non-light-sensitive hydrophilic colloid layers constituting the photographic material of the present invention. Inside-fogged or surface-fogged silver halide grains are such grains that can be non-imagewise uniformly developed irrespective of the non-exposed area and the exposed area of the photographic material. A method of preparing such inside-fogged or surface-fogged silver halide grains is described in U.S. Pat. No. 4,626,498 and JP-A-59-214852.

The silver halide used to form the inside nucleus of an inside-fogged core/shell type silver halide grain may be either one having the same halogen composition or one having a different halogen composition than that used to form the shell. The inside-fogged or surface-fogged silver halide may be any of silver chloride, silver chlorobromide, silver iodobromide or silver chloroiodobromide. The grain size of such a fogged silver halide grain is not specifically defined, and it is preferably from 0.01 to 0.75 μm, especially preferably from 0.05 to 0.6 μm (as a mean grain size). The shape of the grain is also not specifically defined, and it may be either a regular grain or an irregular grain. The emulsion containing such fogged grains may be either a monodispersed one or a polydispersed one. Preferred is a monodispersed one, in which at least 95% by weight or by number of all the silver halide grains therein have a grain size falling within the range of the mean grain size +/−40%.

The photographic material of the present invention preferably contain non-light-sensitive fine silver halide grains. Non-light-sensitive fine silver halide grains are meant to be fine silver halide grains which are not sensitive to the light as imparted to the photographic material for imagewise exposure thereof and are substantially not developed in the step of development of the exposed material. These fine grains are desirably not previously fogged.

The fine silver halide grains have a silver bromide content of from 0 to 100 mol % and, if desired, they may additionally contain silver chloride and/or silver iodide. Preferably, they contain silver iodide in an amount of from 0.5 to 10 mol %.

The fine silver halide grains are desired to have a mean grain size (as a mean value of the circle-corresponding diameter of the projected area) of from 0.01 to 0.5 μm, more preferably from 0.02 to 0.2 μm.

The fine silver halide grains may be prepared by the same method as that used for preparing ordinary light-sensitive silver halide grains. In such a case, the surfaces of the fine silver halide grains to be prepared do not need to be optically sensitized and color sensitization of the grains is also unnecessary. However, prior to addition of the fine grains to the coating composition, it is desirable to previously add a known stabilizer, such as triazole compounds, azaindene compounds, benzothiazolium compounds, or mercapto compounds or zinc compounds, to the coating composition. The fine silver halide grains-containing layer may preferably contain colloidal silver.

The amount of silver as coated in the photographic material of the present invention is preferably 6.0 g/m$^2$ or less, most preferably 4.5 g/m$^2$ or less.

Various known photographic additives which may be used in preparing the photographic materials of the present invention are mentioned in the above-mentioned three Research Disclosures RD 17643, RD 18716 and RD 307105. The related descriptions therein are shown in the following table.

| Kinds of Additives | RD 17643 | RD 18716 | RD 307105 |
|---|---|---|---|
| 1 Chemical Sensitizer | page 23 | page 648, right column | page 866 |
| 2 Sensitivity Enhancer | | page 648, right column | |
| 3 Color Sensitizing Agent and Super Color Sensitizing Agent | pages 23 to 24 | page 648, right column, to page 649, right column | pages 866 to 868 |

-continued

| Kinds of Additives | RD 17643 | RD 18716 | RD 307105 |
|---|---|---|---|
| 4 Brightening Agent | page 24 | | page 868 |
| 5 Anti-foggant and Stabilizer | pages 24 to 25 | page 649, right column | pages 868 to 870 |
| 6 Light Absorbent, Filter Dye and Ultraviolet Absorbent | pages 25 to 26 | page 649, right column to page 650, left column | page 873 |
| 7 Stain Inhibitor | page 25, right column | page 650, left column to right column | page 872 |
| 8 Color Image Stabilizer | page 25 | page 650, left column | page 872 |
| 9 Hardening Agent | page 26 | page 651, left column | pages 874 to 875 |
| 10 Binder | page 26 | page 651, left column | page 873 to 874 |
| 11 Plasticizer and Lubricant | page 27 | page 650, right column | page 876 |
| 12 Coating Aid and Surfactant | pages 26 to 27 | page 650, right column | pages 875 to 876 |
| 13 Antistatic Agent | page 27 | page 650, right column | pages 876 to 877 |
| 14 Mat Agent | | | pages 878 to 879 |

In order to prevent deterioration of the photographic property of the photographic material of the invention by formaldehyde gas as imparted thereto, compounds capable of reacting with formaldehyde so as to solidify it, for example, those described in U.S. Pat. Nos. 4,411,987 and 4,435,503, are preferably incorporated into the materials of the present invention.

It is preferred to incorporate mercapto compounds described in U.S. Pat. Nos. 4,740,454 and 4,788,132 and JP-A-62-18539 and JP-A-1-283551 into the photographic materials of the present invention.

It is also preferred to incorporate, into the photographic materials of the present invention, compounds capable of releasing a foggant, a development accelerator, a silver halide solvent or a precursor thereof, irrespective of the amount of the developed silver as formed by development, which are described in JP-A-1-106052.

It is also preferred to incorporate, into the photographic materials of the present invention, dyes as dispersed by the method described in International Patent Laid-Open No. WO88/04794 and Japanese Patent Kohyo Koho Hei-1-5029, or dyes as described in European Patent 317,308A, U.S. Pat. No. 4,420,555 and JP-A-1-259358.

Various color couplers can be incorporated into the photographic material of the present invention, and examples of usable color couplers are described in patent publications as referred to in the above-mentioned RD No. 17643, VII-C to G, and RD No. 307105, VII-C to G.

As yellow couplers, for example, those described in U.S. Pat. Nos. 3,933,501, 4,022,620, 4,326,024, 4,401,752, 4,248,961, JP-B-58-10739, British Patents 1,425,020, 1,476,760, U.S. Pat. Nos. 3,973,968, 4,314,023, 4,511,649, and European Patent 249,473A are preferred.

As magenta couplers, 5-pyrazolone compounds and pyrazoloazole compounds are preferred. For instance, those described in U.S. Pat. Nos. 4,310,619, 4,351,897, European Patent 73,636, U.S. Pat. Nos. 3,061,432, 3,725,045, RD No. 24220 (June, 1984), JP-A-60-33552, RD No. 24230 (June, 1984), JP-A-60-43659, JP-A-61-72238, JP-A-60-35730, JP-A-55-118034, JP-A-60-185951, U.S. Pat. Nos. 4,500,630, 4,540,654, 4,556,630, and WO(PCT)88/04795 are preferably used in the present invention, in addition to the preceding couplers of formula (I) of the present invention.

As cyan couplers, phenol couplers and naphthol couplers are preferred. For instance, those described in U.S. Pat. Nos. 4,052,212, 4,146,396, 4,228,122, 4,296,200, 2,369,929, 2,801,171, 2,771,162, 2,895,816, 3,772,002, 3,758,308, 4,334,011, 4,327,173, German Patent (OLS) No. 3,329,729, European Patents 121,365A, 249,453A, U.S. Pat. Nos. 3,446,622, 4,333,999, 4,753,871, 4,451,559, 4,427,767, 4,690,889, 4,254,212, 4,296,199, and JP-A-61-42658 are preferred. In addition, pyrazoloazole couplers described in JP-A-64-553, JP-A-64-554, JP-A-64-555 and JP-A-64-556 and imidazole couplers as described in U.S. Pat. No. 4,818,672 are also usable.

Polymerized dye-forming couplers may also be used, and typical examples of such couplers are described in U.S. Pat. Nos. 3,451,820, 4,080,211, 4,367,282, 4,409,320, 4,576,910, British Patent 2,102,137 and European Patent 341,188A.

Couplers capable of forming-a colored dyes having a pertinent diffusibility may also be used, and those described in U.S. Pat. No. 4,366,237, British Patent 2,125,570, European Patent 96,570, and German Patent OLS No. 3,234,533 are preferred.

As colored couplers for correcting the unnecessary absorption of colored dyes, those described in RD No. 17643, VII-G, RD No. 307105, VII-G, U.S. Pat. No. 4,163,670, JP-B-57-39413, U.S. Pat. Nos. 4,004,929, 4,138,258, and British Patent 1,146,368 are preferred. Additionally, couplers capable of correcting the unnecessary absorption of the colored dyed by a phosphor dye released during coupling, as described in U.S. Pat. No. 4,774,181, as well as couplers having a dye precursor group capable of reacting with a developing agent to form a dye, as a split-off group, as described in U.S. Pat. No. 4,777,120 are also preferably used.

Couplers capable of releasing a photographically useful residue along with coupling may also be used in the present invention. For instance, as DIR couplers capable of releasing a development inhibitor, those described in the patent publications as referred to in the above-mentioned RD No. 17643, Item VII-F, RD No. 307105, Item VII-F, as well as those described in JP-A-57-151944, JP-A-57-154234, JP-A-60-184248, JP-A-63-37346 and JP-A-63-37350 and U.S. Pat. Nos. 4,248,962 and 4,782,012 are preferred.

Couplers capable of releasing a bleaching accelerator, as described in RD Nos. 11449 and 24241 and JP-A-61-201247, are effective for shortening the time for the processing step with a processing solution having a bleaching capacity, and the effect is especially noticeable when they are added to a photographic material of the present invention containing the above-mentioned tabular silver halide grains.

As couplers capable of imagewise releasing a nucleating agent or development accelerator during development, those described in British Patents 2,097,140 and 2,131,188, and JP-A-59-157638 and JP-A-59-170840 are preferred. In addition, compounds capable of releasing a foggant, a development accelerator or a silver halide solvent by redox reaction with an oxidation product of a developing agent, as described in JP-A-60-107029, JP-A-60-252340, JP-A-1-44940 and JP-A-1-45687, are also preferably used.

Additionally, as examples of compounds which may be incorporated into the photographic materials of the present invention, there are further mentioned competing couplers described in U.S. Pat. No. 4,130,427; polyvalent couplers described in U.S. Pat. Nos. 4,238,472, 4,338,393 and 4,310,618; DIR redox compound-releasing couplers, DIR coupler-releasing couplers, DIR coupler-releasing redox compounds and DIR redox-releasing redox compounds described in JP-A-60-185950 and JP-A-62-24252; couplers capable of releasing a dye which recolors after released from the coupler, as described in European Patents 173,302A and 313,308A; ligand-releasing couplers described in U.S. Pat. No. 4,553,477; leuco dye-releasing couplers described in JP-A-63-75747; and couplers capable of releasing a phosphor dye as described in U.S. Pat. No. 4,774,181.

The above-mentioned couplers can be incorporated into the photographic materials of the present invention by various known dispersion methods.

For instance, an oil-in-water dispersion method may be employed for the purpose. Examples of high boiling point solvents usable in the method are described in U.S. Pat. No. 2,322,027. As examples of high boiling point organic solvents having a boiling point of 175° C. or higher at normal pressure, which are used in an oil-in-water dispersion, there are mentioned phthalates (e.g., dibutyl phthalate, dicyclohexyl phthalate, di-2-ethylhexyl phthalate, decyl phthalate, bis(2,4-di-t-amylphenyl) phthalate, bis(2,4-di-t-amylphenyl) isophthalate, bis(1,1-diethylpropyl) phthalate), phosphates or phosphonates (e.g., triphenyl phosphate, tricresyl phosphate, 2-ethylhexyl diphenylphosphate, tricyclohexyl phosphate, tri-2-ethylhexyl phosphate, tridodecyl phosphate, tributoxyethyl phosphate, trichloropropyl phosphate, di-2-ethylhexylphenyl phosphonate), benzoates (e.g., 2-ethylhexyl benzoate, dodecyl benzoate, 2-ethylhexyl p-hydroxybenzoate), amides (e.g., N,N-diethyldodecanamide, N,N-diethyllaurylamide, N-tetradecylpyrrolidone), alcohols or phenols (e.g., isostearyl alcohol, 2,4-di-tert-amylphenol), aliphatic carboxylates (e.g., bis(2-ethylhexyl) sebacate, dioctyl azelate, glycerol tributylate, isostearyl lactate, trioctyl citrate), aniline derivatives (e.g., N,N-dibutyl-2-butoxy-5-tert-octylaniline), hydrocarbons (e.g., paraffin, dodecylbenzene, diisopropylnaphthalene). As an auxiliary solvent, organic solvents having a boiling point of approximately from 30° to 160° C., preferably from 50° to 160° C. can be used. As examples of such auxiliary organic solvents, there are mentioned ethyl acetate, butyl acetate, ethyl propionate, methyl ethyl ketone, cyclohexanone, 2-ethoxyethyl acetate and dimethylformamide.

A latex dispersion method may also be employed for incorporating couplers into the photographic material of the present invention. The steps of carrying out the dispersion method, the effect of the method and examples of latexes usable in the method for impregnation are described in U.S. Pat. No. 4,199,363, German Patent (OLS) Nos. 2,541,274 and 2,541,230.

The color photographic material of the present invention preferably contains an antiseptic or fungicide of various kinds, for example, selected from phenethyl alcohol and those described in JP-A-63-257747, JP-A-62-272248 and JP-A-1-80941, such as 1,2-benzisothiazolin-3-one, n-butyl p-hydroxybenzoate, phenol, 4-chloro-3,5-dimethylphenol, 2-phenoxyethanol or 2-(4-thiazolyl)benzimidazole.

The present invention may apply to various color photographic materials. For instance, there are mentioned, as typical examples, color negative films for general use or for movie use, color reversal films for slide use or for television use, as well as color papers, color positive films and color reversal papers.

Suitable supports which are usable in the present invention are described in, for example, the above-mentioned RD No. 17643, page 28, RD No. 18716, from page 647, right column to page 648, left column, and RD No. 307105, page 897.

It is desired that the total film thickness of all the hydrophilic colloid layers as provided on the surface of the support having emulsion layers is 28 microns or less, preferably 23 microns or less, more preferably 18 microns or less, especially preferably 16 microns or less, in the photographic material of the present invention. It is also desired that the photographic materials of the invention possess a film swelling rate ($T_{\frac{1}{2}}$) of 30 seconds or less, preferably 20 seconds or less. The film thickness as referred to herein is one as measured under the controlled condition of a temperature of 25° C. and a relative humidity of 55% (for 2 days); and the film swelling rate as referred to herein may be measured by any means known in this technical field. For instance, it may be measured by the use of a swellometer of the model as described in A. Green et al., Photographic Science Engineering, Vol. 19, No. 2, pages 124 to 129. The film swelling rate ($T_{\frac{1}{2}}$) is defined as follows: 90% of the maximum swollen thickness of the photographic material as processed in a color developer under the condition of 30° C. and 3 minutes and 15 seconds is called a saturated swollen thickness. The time necessary for attaining a half of the saturated swollen thickness is defined to be a film swelling rate ($T_{\frac{1}{2}}$).

The film swelling rate ($T_{\frac{1}{2}}$) can be adjusted by adding a hardening agent to gelatin of a binder or by varying the condition of storing the coated photographic material. Additionally, the photographic material of the present invention is desired to have a swelling degree of from 150 to 400%. The swelling degree as referred to herein is calculated from the maximum swollen film thickness as obtained under the above-mentioned condition, on the basis of a formula of:

(maximum swollen film thickness—original film thickness)/(original film thickness).

It is preferred that the photographic material of the present invention possess a hydrophilic colloid layer having a total dry thickness of from 2 μm to 20 μm on the side opposite to the side of having the emulsion layers. The layer is referred to as a backing layer. It is preferred that the backing layer contains various additives of the above-mentioned light absorbent, filter dye, ultraviolet absorbent, antistatic agent, hardening agent, binder, plasticizer, swelling agent, coating aid and surfactant. The backing layer is desired to have a swelling degree of from 150 to 500%.

The color photographic material of the present invention can be developed by any ordinary method, for example, in accordance with the process described in the above-mentioned RD No. 17643, pages 28 and 29, RD No. 18716, page 615, from left column to right column, and RD No. 307105, pages 880 to 881.

The color developer to be used for development of the photographic material of the present invention is preferably an aqueous alkaline solution consisting essentially of an aromatic primary amine color-developing agent. As the color-developing agent, p-phenylenediamine compounds are preferably used, though aminophenol compounds are also useful. Specific examples of p-phenylenediamine compounds usable as the color-developing agent include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-β-methoxyethylaniline, 4-amino-3-methyl-N-methyl-N-(3-hydroxypropyl)aniline, 4-amino-3-methyl-N-ethyl-N-(3-hydroxypropyl)aniline, 4-amino-3-methyl-N-ethyl-N-(2-hydroxypropyl)aniline, 4-amino-3-ethyl-N-ethyl-N-(3-hydroxypropyl)aniline, 4-amino-3-methyl-N-propyl-N-( 3-hydroxypropyl)aniline, 4-amino-3-propyl-N-methyl-N-(3-hydroxypropyl)aniline, 4-amino-3-methyl-N-methyl-N-(4-hydroxybutyl)aniline, 4-amino-3-methyl-N-methyl-N-(4-hydroxybutyl-)aniline, 4-amino-3-methyl-N-propyl-N-(4-hydroxybutyl)aniline, 4-amino-3-ethyl-N-ethyl-N-(3-hydroxy-2-methylpropyl)aniline, 4-amino-3-methyl-N,N-bis(4-hydroxybutyl)aniline, 4-amino-3-methyl-N,N-bis(5-hydroxypentyl)aniline, 4-amino-3-methyl-N-(5-hydroxypentyl)-N-(4-hydroxybutyl)aniline, 4-amino-3-methoxy-N-ethyl-N-(4-hydroxybutyl)aniline, 4-amino-3-ethoxy-N,N-bis(5-hydroxypentyl)aniline, 4-amino-3-propyl-N-(4-hydroxybutyl)aniline, as well as sulfates, hydrochlorides and p-toluenesulfonates of the compounds. Above all, especially preferred are 3-methyl-4-amino-N-ethyl-N-β-hydroxyethylaniline, 4-amino-3-methyl-N-ethyl-N-(3-hydroxypropyl)aniline, 4-amino-3-methyl-N-ethyl-N-(4-hydroxybutyl)aniline, and their hydrochlorides, p-toluenesulfonates and sulfates, These compounds can be used in combination of two or more of them, in accordance with the object.

The color developer generally contains a pH buffer such as alkali metal carbonates, borates or phosphates, and a development inhibitor or anti-foggant such as chlorides, bromides, iodides, benzimidazoles, benzothiazoles or mercapto compounds. If desired, it may also contain various preservatives such as hydroxylamine, diethylhydroxylamine, sulfites, hydrazines such as N,N-biscarboxymethylhydrazine, phenylsemicarbazides, triethanolamine, catechol-sulfonic acids; an organic solvent such as ethylene glycol, and diethylene glycol; a development accelerator such as benzyl alcohol, polyethylene glycol, quaternary ammonium salts, and amines; a dye-forming coupler; a competing coupler; an auxiliary developing agent such as 1-phenyl-3-pyrazolidone; a tackifier; as well as various chelating agents such as aminopolycarboxylic acids, aminopolyphosphonic acids, alkylphosphonic acids, and phosphonocarboxylic acids. As specific examples of chelating agents which may be incorporated into the color developer, there are mentioned ethylenediamine-tetraacetic acid, nitrilo-triacetic acid, diethylenetriamine-pentaacetic acid, cyclohexanediaminetetraacetic acid, hydroxylethylimino-diacetic acid, 1-hydroxyethylidene-1,1-diphosphonic acid, nitrilo-N,N,N-trimethylene-phosphonic acid, ethylenediamine-N,N,N,N-tetramethylene-phosphonic acid, ethylenediamine-di(o-hydroxyphenylacetic acid) and their salts.

Where the photographic material is processed for reversal finish, in general, it is first subjected to black-and-white development and then subjected to color development. For the first black-and-white development is used a black-and-white developer, which contains a conventional black-and-white developing agent, for example, dihydroxybenzenes such as hydroquinone, 3-pyrazolidones such as 1-phenyl-3-pyrazolidone, or aminophenols such as N-methyl-p-aminophenol, singularly or in combination. The color developer and the black-and-white developer generally has a pH value of from 9 to 12. The amount of the replenisher to the developer is, though depending upon the the color photographic material to be processed, generally 3 liters or less per $m^2$ of the material to be processed. It may be reduced to 500 ml or less per $m^2$ of the material to be processed, by lowering the bromide ion concentration in the replenisher. Where the amount of the replenisher is reduced, it is preferred to reduce the contact area of the surface of the processing solution in the processing tank with air so as to prevent vaporization and aerial oxidation of the solution.

The contact surface area of the processing solution with air in the processing tank is represented by the opening ratio which is defined by the following formula:

| |
|---|
| Opening Ratio = (Contact Surface Area ($cm^2$) of Processing Solution with Air)/(Volume ($cm^3$) of Processing Tank) |

The above-mentioned opening ratio is preferably 0.1 or less, more preferably from 0.001 to 0.05. Various means can be employed for the purpose of reducing the opening ratio, which include, for example, provision of a masking substance such as a floating lid on the surface of the processing solution in the processing tank, employment of the mobile lid described in JP-A 1-82033 and employment of the slit-developing method described in JP-A 63-216050. Reduction of the opening ratio is preferably applied to not only the both steps of color development and black-and-white development but also all the subsequent steps such as bleaching, bleach-fixation, fixation, rinsing and stabilization steps. In addition, the amount of the replenisher to be added may also be reduced by means of suppressing accumulation of bromide ions in the developer.

The time for color development is generally within the range of from 2 minutes to 5 minutes, but the processing time may be shortened by elevating the processing temperature, elevating the pH value of the processing solution and elevating the concentration of the processing solution.

After color development, the photographic emulsion layer is generally bleached. Bleaching may be effected simultaneously with fixation (bleach-fixation) or separately therefrom. In order to accelerate the processing speed, a system of bleaching followed by bleach-fixation may also be employed. If desired, a system of using a continuous bleach-fixing bath having two tanks, a system of fixation followed by bleach-fixation, or a system of bleach-fixation followed by bleaching may also be employed. As the bleaching agent there can be used, for example, compounds of polyvalent metals such as iron(III), as well as peracids, quinones and nitro compounds. Specific examples of the bleaching agent usable in the present invention include organic complexes of iron(III), such as complexes thereof with amino-polycarboxylic acids such as ethylenediaminetetraacetic acid, diethylenetriaminepentaacetic acid, cyclohexanediamine-tetraacetic acid, methyliminodiacetic acid, 1,3-diaminopropane-tetraacetic acid or glycol ether-diamine-tetraacetic acid or with organic acids such as citric acid, tartaric acid or malic acid. Among them, aminopolycarboxylato/iron(III) complexes such as ethylenediaminetetraacetato/iron(III) complex and 1,3-diaminopropane-tetraacetato/iron(III) complex are preferred in view of the rapid processability thereof and of prevention of environmental pollution. The aminopolycarboxylato/iron(III) complexes are especially useful both in a bleaching solution and in a bleach-fixing solution. The bleaching solution or bleach-fixing solution containing such aminopolycarboxylato/iron(III) complexes generally has a pH value of from 4.0 to 8.0, but the solution may have a lower pH value for rapid processing.

The bleaching solution, the bleach-fixing solution and the previous bath may contain a bleaching accelerating agent, if desired. Various bleaching accelerating agents are known, and examples of the agents which are advantageously used in the present invention include mercapto group- or disulfide group-containing compounds described in U.S. Pat. No. 3,893,858, German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623 and JP-A-53-28426, RD No. 17129 (July, 1978); thiazolidine derivatives as described in JP-A-50-140129; thiourea derivatives as described in JP-B-45-8506, JP-A-52-20832 and JP-A-53-32735 and U.S. Pat. No. 3,706,561; iodide salts as described in German Patent 1,127,715 and JP-A-58-16235; polyoxyethylene compounds as described in German Patents 966,410 and 2,748,4.30; polyamine compounds as described in JP-B-45-8836; other compounds as described in JP-A-49-40943, JP-A-49-59644, JP-A-53-94927, JP-A-54-35727, JP-A-55-26506 and JP-A-58-163940; and bromide ions. Above all, mercapto group- or disulfide group-containing compounds, in particular, those as described in U.S. Pat. No. 3,893,858, German Patent 1,290,812 and JP-A-53-95630 are preferred, as having a large accelerating effect. In addition, compounds described in U.S. Pat. No. 4,552,834 are also preferred. These bleaching accelerators may be incorporated into the photographic material of the invention. Where the material of the invention is a picture-taking color photographic material and it is bleach-fixed, these bleaching accelerators are especially effective.

The bleaching solution and bleach-fixing solution may further contain, in addition to the above-mentioned components, various organic acids for the purpose of preventing bleaching stains. Especially preferred organic acids for the purpose are those having an acid dissociating constant (pKa) of from 2 to 5. For instance, acetic acid, propionic acid and hydroxyacetic acid are preferably used.

As the fixing agent in the fixing solution or bleach-fixing solution applied to the photographic materials of the invention, those usable are thiosulfates, thiocyanates, thioether compounds, thioureas, and a large amount of iodide salts. Generally, thiosulfates are used for the purpose. Above all, ammonium thiosulfate is most widely used. Additionally, the combination of thiosulfates and thiocyanates, thioether compounds or thioureas is also preferred. As the preservative to be used in the fixing solution or bleach-fixing solution, preferred are sulfites, bisulfites and carbonyl-bisulfite adducts, as well as sulfinic acid compounds as described in European Patent 294769A. Further, the fixing solution or bleach-fixing solution may preferably contain various aminopolycarboxylic acids or organic phosphonic acids for the purpose of stabilizing the solution.

It is preferred that the fixing solution or bleach-fixing solution used for processing the photographic materials of the present invention contain compounds having a pKa value of from 6.0 to 9.0, for the purpose of adjusting the pH value of the solution. As such compounds, preferably added are imidazoles such as imidazole, 1-methylimidazole, 1-ethylimidaozle or 2-methylimidazole, in an amount of from 0.1 to 10 mol/liter.

The total time for the desilvering process is preferably shorter within the range of not causing desilvering insufficiency. For instance, the time is preferably from 1 minute to 3 minutes, more preferably from 1 minute to 2 minutes. The processing temperature may be from 25° C. to 50° C., preferably from 35° C. to 45° C. In such a preferred temperature range, the desilvering speed is accelerated and generation of stains in the processed material may effectively be prevented.

In the desilvering process, it is desired that stirring of the processing solution during the process be promoted as much as possible. As examples of reinforced stirring means for forcedly stirring the photographic material during the desilvering step, there are mentioned: a method of running a jet stream of the processing solution to the emulsion-coated surface of the material, as described in JP-A-62-183460; a method of promoting the stirring effect by the use of a rotating means, as described in JP-A-62-183461; a method of moving the photographic material being processed in the processing bath while the emulsion-coated surface of the material is brought into contact with a wiper blade as provided in the processing bath, whereby the processing solution as applied to the emulsion-coated surface of the material is made turbulent and the stirring effect is promoted; and a method of increasing the total circulating amount of the processing solution. Such reinforced stirring means are effective as to the bleaching solution, bleach-fixing solution and fixing solution described above. It is considered that a reinforcement of stirring for the processing solution would promote penetration of the bleaching agent and fixing agent into the emulsion layer of the photographic material being processed and, as a result, the desilvering rate in processing the material would be elevated. The above-mentioned reinforced stirring means is more effectives when a bleaching accelerator is incorporated into the processing solution. Using such means, therefore, the bleaching accelerating effect could remarkably be augmented, and the fixation preventing effect caused by the bleaching accelerator could be evaded.

The photographic material of the present invention can be processed with an automatic developing machine. It is desirable that the automatic developing machine used for processing the material of the present invention be equipped with a photographic material-conveying means as described in JP-A-60-191257, JP-A-60-191258 and JP-A-60-191259. As is noted from the related disclosure of JP-A-60-191257, the conveying means may noticeably reduce the carry-over amount from the previous bath to the subsequent bath and therefore it is extremely effective for preventing deterioration of the processing solution being used. Because of these reasons, the conveying means is especially effective for shortening the processing time in each processing step-and for reducing the amount of the replenisher added to each processing bath.

The silver halide color photographic material of the present invention is generally rinsed in water and/or stabilized, after being desilvered. The amount of the water to be used in the rinsing step can be set in a broad range, in accordance with the characteristic of the photographic material being processed (for example, depending upon the raw material components, such as the coupler and so on) or the use of the material, as well as the temperature of the rinsing water, the number of the rinsing tanks (the number of the rinsing stages), the replenishment system being either a normal current or countercurrent system, and other various kinds of conditions. Among these conditions, the relation between the number of the rinsing tanks and the amount of the rinsing water in a multi-stage countercurrent rinsing system can be obtained by the method described in *Journal of the Society of Motion Picture and Television Engineers,* Vol. 64, pages 248 to 253 (May, 1955).

According to the multi-stage countercurrent system described in the above-mentioned reference, the amount of the rinsing water to be used can be reduced noticeably, but because of the prolongation of the residence time of the water in the rinsing tank, bacteria would propagate in the tank so that the floating substances generated by the propagation of bacteria would adhere to the surface of the material as it was processed. Accordingly, the above system would often have a problem. In the practice of processing the photographic material of the present invention, the method of reducing calcium and magnesium ions, which is described in JP-A-62-288838, can extremely effectively be used for overcoming this problem. In addition, isothiazolone compounds and thiabendazoles described in JP-A-57-8542; chlorine-containing bactericides such as chlorinated sodium isocyanurates; and benzotriazoles and other bactericides described in H. Horiguchi, *Chemistry of Bactericidal and Fungicidal Agents* (1986, by Sankyo Publishing Co., Japan), *Bactericidal and Fungicidal Techniques to Microorganisms,* edited by Association of Sanitary Technique, Japan (1982, by Kogyo Gijutsukai, Japan), and *Encyclopeadia of Bactericidal and Fungicidal Agents,* edited by Nippon Bactericide and Fungicide Association, Japan (1986), can also be used.

The pH value of the rinsing water to be used for processing the photographic material of the present invention is from 4 to 9, preferably from 5 to 8. The temperature of the rinsing water and the rinsing time can also be set variously in accordance with the characteristics of the photographic material being processed as well as the use thereof, and in general, the temperature is from 15° to 45° C. and the time is from 20 seconds to 10 minutes, and preferably the temperature is from 25° to 40° C. and the time is from 30 seconds to 5 minutes. Alternatively, the photographic material of the present invention may also be processed directly with a stabilizing solution in place of being rinsed with water. For the stabilization, any known methods, for example, as described in JP-A-57-8543, JP-A-58-14834 and JP-A-60-220345, can be employed.

In addition, the material can also be stabilized, following the rinsing step. As one example of the case, there may be mentioned a stabilizing bath containing a dye stabilizer and a surfactant, which is used as a final bath for picture-taking color photographic materials. As examples of dye stabilizers usable for the purpose, there are mentioned aldehydes such as formalin and glutaraldehyde, N-methylol compounds, hexamethylenetetramine and aldehyde-sulfite adducts. The stabilizing bath may also contain various chelating agents and fungicides.

The overflow from the rinsing and/or stabilizing solutions because of addition of replenishers thereto may be re-used in the other steps such as the previous desilvering step.

Where the photographic material of the present invention is processed with an automatic developing machine system and wherein the processing solutions being used in the step are evaporated and thickened, it is desirable to add water to the solutions so as to correct the concentration of the solutions.

The silver halide color photographic material of the present invention can contain a color developing agent for the purpose of simplifying and accelerating the processing of the material. For incorporation of a color developing agent into the photographic material, various precursors of the agent are preferably used. For example, there are mentioned indoaniline compounds described in U.S. Pat. No. 3,342,597, Schiff base compounds described in U.S. Pat. No. 3,342,599 and RD Nos. 14850 and 15159, aldole compounds described in RD No. 13924, metal complexes described in U.S. Pat. No. 3,719,492 and urethane compounds described in JP-A-53-135628, as the precursors.

The silver halide color photographic material of the present invention can contain various kinds of 1-phenyl-3-pyrazolidones, if desired, for the purpose of accelerating the color developability thereof. Specific examples of these compounds are described in JP-A-56-64339, JP-A-57-144547 and JP-A-58-115438.

The processing solutions for the photographic material of the invention are used at 10° C. to 50° C. In general, a processing temperature of from 33° C. to 38° C. is standard, but the temperature may be made higher so as to accelerate the processing or to shorten the processing time. Alternatively, the temperature may be made lower so as to improve the quality of images formed and to improve the stability of the processing solution used.

The silver halide color photographic material of the present invention is especially effectively applied to lens-combined film units such as those described in JP-B-2-32615 and Japanese Utility Model Publication No. 3-39784, as easily expressing the effect.

Next, the present invention will be explained in more detail by way of the following examples, which, however, are not intended to restrict the scope of the present invention.

EXAMPLE 1

Plural layers each having the composition mentioned below were coated on a subbing layer-coated cellulose triacetate support, to prepare a multi-layer color photographic material sample 101.

Compositions of Photographic Layers

Essential components of constituting the photographic layers are grouped as follows:

ExC: Cyan Coupler
UV: Ultraviolet Absorbent
ExM: Magenta Coupler

HBS: High Boiling Point Organic Solvent
ExY: Yellow Coupler
H: Gelatin Hardening Agent
ExS: Sensitizing Dye The number for each component indicates the amount coated by way of a unit of g/m$^2$. The amount of silver halide coated is represented as the amount of silver therein coated. The amount of sensitizing dye coated is represented by way of a molar unit to mol of silver halide in the same layer.

| Sample 101: | |
|---|---|
| First Layer: Anti-halation Layer | |
| Black Colloidal Silver | 0.18 as Ag |
| Gelatin | 1.40 |
| ExM-1 | 0.18 |
| ExF-1 | $2.0 \times 10^{-3}$ |
| Second Layer: Interlayer | |
| Emulsion G | 0.065 as Ag |
| 2,5-Di-t-pentadecylhydroquinone | 0.18 |
| ExC-2 | 0.020 |
| UV-1 | 0.060 |
| UV-2 | 0.080 |
| UV-3 | 0.10 |
| HBS-1 | 0.10 |
| HBS-2 | 0.020 |
| Gelatin | 1.04 |
| Third Layer: Low-sensitivity Red-sensitive Emulsion Layer | |
| Emulsion A | 0.25 as Ag |
| Emulsion B | 0.25 as Ag |
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.17 |
| ExC-4 | 0.17 |
| ExC-7 | 0.020 |
| UV-1 | 0.070 |
| UV-2 | 0.050 |
| UV-3 | 0.070 |
| HBS-1 | 0.060 |
| Gelatin | 0.87 |
| Fourth Layer: Middle-sensitivity Red-sensitive Emulsion Layer | |
| Emulsion D | 0.80 as Ag |
| ExS-1 | $3.5 \times 10^{-4}$ |
| EXS-2 | $1.6 \times 10^{-5}$ |
| ExS-3 | $5.1 \times 10^{-4}$ |
| ExC-1 | 0.20 |
| ExC-2 | 0.050 |
| ExC-4 | 0.20 |
| ExC-5 | 0.050 |
| ExC-7 | 0.015 |
| UV-1 | 0.070 |
| UV-2 | 0.050 |
| UV-3 | 0.070 |
| Gelatin | 1.30 |
| Fifth Layer: High-sensitivity Red-sensitive Emulsion Layer | |
| Emulsion E | 1.40 as Ag |
| ExS-1 | $2.4 \times 10^{-4}$ |
| ExS-2 | $1.0 \times 10^{-4}$ |
| ExS-3 | $3.4 \times 10^{-4}$ |
| ExC-1 | 0.097 |
| ExC-2 | 0.010 |
| ExC-3 | 0.065 |
| ExC-6 | 0.020 |
| HBS-1 | 0.22 |
| HBS-2 | 0.10 |
| Gelatin | 1.63 |
| Sixth Layer: Interlayer | |
| Cpd-1 | 0.040 |
| HBS-1 | 0.020 |
| Gelatin | 0.80 |
| Seventh Layer: Low-sensitivity Green-sensitive Emulsion Layer | |
| Emulsion C | 0.30 as Ag |
| ExS-4 | $2.6 \times 10^{-5}$ |
| ExS-5 | $1.8 \times 10^{-4}$ |
| ExS-6 | $6.9 \times 10^{-4}$ |
| ExM-1 | 0.021 |
| ExM-2 | 0.26 |

-continued

| Sample 101: | |
|---|---|
| ExM-3 | 0.030 |
| ExY-1 | 0.025 |
| HBS-1 | 0.10 |
| HBS-3 | 0.010 |
| Gelatin | 0.63 |
| Eighth Layer: Middle-sensitivity Green-sensitive Emulsion Layer | |
| Emulsion D | 0.55 as Ag |
| ExS-4 | $2.2 \times 10^{-5}$ |
| ExS-5 | $1.5 \times 10^{-4}$ |
| ExS-6 | $5.8 \times 10^{-4}$ |
| ExM-2 | 0.094 |
| ExM-3 | 0.026 |
| ExY-1 | 0.018 |
| HBS-1 | 0.16 |
| HBS-3 | $8.0 \times 10^{-3}$ |
| Gelatin | 0.50 |
| Ninth Layer: High-sensitivity Green-sensitive Emulsion Layer | |
| Emulsion E | 1.40 as Ag |
| ExS-4 | $4.3 \times 10^{-5}$ |
| ExS-5 | $1.0 \times 10^{-4}$ |
| ExS-6 | $3.3 \times 10^{-4}$ |
| ExC-1 | 0.005 |
| ExM-1 | 0.013 |
| Comparative Coupler (a) | 0.080 |
| HBS-1 | 0.25 |
| HBS-2 | 0.10 |
| Gelatin | 1.30 |
| Tenth Layer: Yellow Filter Layer | |
| Yellow Colloidal Silver | 0.035 as Ag |
| Cpd-1 | 0.080 |
| HBS-1 | 0.030 |
| Gelatin | 0.95 |
| Eleventh Layer: Low-sensitivity Blue-sensitive Emulsion Layer | |
| Emulsion C | 0.18 as Ag |
| ExS-7 | $8.6 \times 10^{-4}$ |
| ExY-1 | 0.042 |
| ExY-2 | 0.72 |
| HBS-1 | 0.28 |
| Gelatin | 1.10 |
| Twelfth Layer: Middle-sensitivity Blue-sensitive Emulsion Layer | |
| Emulsion D | 0.40 as Ag |
| ExS-7 | $7.4 \times 10^{-4}$ |
| ExC-7 | $7.0 \times 10^{-3}$ |
| ExY-2 | 0.15 |
| HBS-1 | 0.050 |
| Gelatin | 0.78 |
| Thirteenth Layer: High-sensitivity Blue-sensitive Emulsion Layer | |
| Emulsion F | 0.70 as Ag |
| ExS-7 | $2.8 \times 10^{-4}$ |
| ExY-2 | 0.20 |
| HBS-1 | 0.070 |
| Gelatin | 0.69 |
| Fourteenth Layer: First Protective Layer | |
| Emulsion G | 0.20 as Ag |
| UV-4 | 0.11 |
| UV-5 | 0.17 |
| HBS-1 | $5.0 \times 10^{-2}$ |
| Gelatin | 1.00 |
| Fifteenth Layer: Second Protective Layer | |
| H-1 | 0.40 |
| B-1 (diameter 1.7 μm) | $5.0 \times 10^{-2}$ |
| B-2 (diameter 1.7 μm) | 0.10 |
| B-3 | 0.10 |
| S-1 | 0.20 |
| Gelatin | 1.20 |

In addition, the respective layers may contain any of W-1 through W-3, B-4 through B-6, F-1 through F-17, and iron salt, lead salt, gold salt, platinum salt, iridium salt and rhodium salt, so as to have improved storability, processability, pressure resistance, fungicidal and bactericidal property, antistatic property and coatability.

Structural formulae of the compounds used as well as the the emulsions used are shown below.

TABLE 3

| | Mean AgI Content (%) | Mean Grain Size (μm) | Coefficient of Variation to Grain Size (%) | Ratio of Diameter/ Thickness | Ratio of Silver Contents [core/interlayer/shell] (as AgI content %) | Structure and Shape of Grains |
|---|---|---|---|---|---|---|
| Emulsion A | 4.0 | 0.45 | 27 | 1 | [1/3] (13/1) | two-layer structural octahedral grains |
| Emulsion B | 8.9 | 0.70 | 14 | 1 | [3/7] (25/2) | two-layer structural octahedral grains |
| Emulsion C | 2.0 | 0.55 | 25 | 7 | — | uniform structural tabular grains |
| Emulsion D | 9.0 | 0.65 | 25 | 6 | [12/59/29] (0/11/8) | three-layer structural tabular grains |
| Emulsion E | 9.0 | 0.85 | 23 | 5 | [8/59/33] (0/11/8) | three-layer structural tabular grains |
| Emulsion F | 14.5 | 1.25 | 25 | 3 | [37/63] (34/3) | two-layer structural tabular grains |
| Emulsion G | 1.0 | 0.07 | 15 | 1 | — | uniform structural fine grains |

In Table 3, Emulsions A to F are subjected to reduction sensitization using thiourea dioxide and thiosulfonic acid during the formation of the grains in accordance with the example of JP-A-2-191938. In addition, Emulsions A to F are subjected to gold-sensitization, sulfur sensitization and selen sensitization in the presence of the spectral sensitizing dye(s) recited in each of the light-sensitive layers above and sodium thiocyanate. In the formation of the tabular grains, a low molecular gelatin is used in accordance with the example of JP-A-1-158426. In the tabular grains and the normal crystal grains, dislocation lines as disclosed in JP-A-3-237450 are observed using a high-pressure electron microscope.

ExC-1

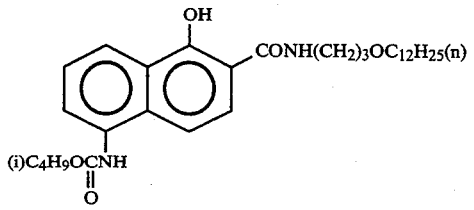

ExC-2

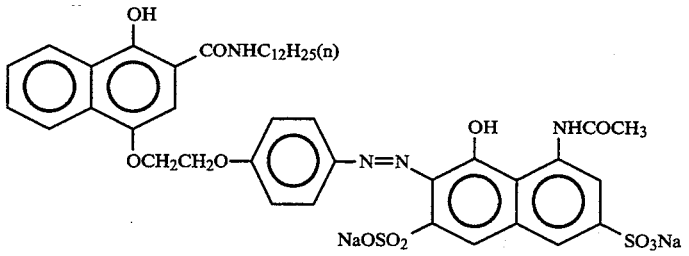

ExC-3

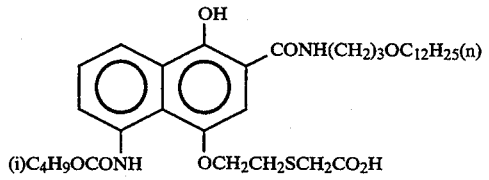

ExC-4

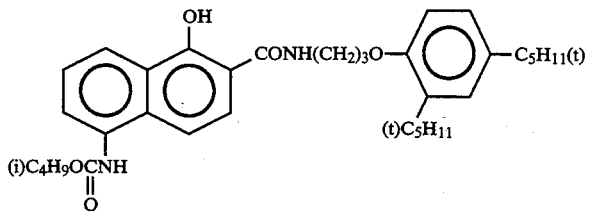

-continued
ExC-5
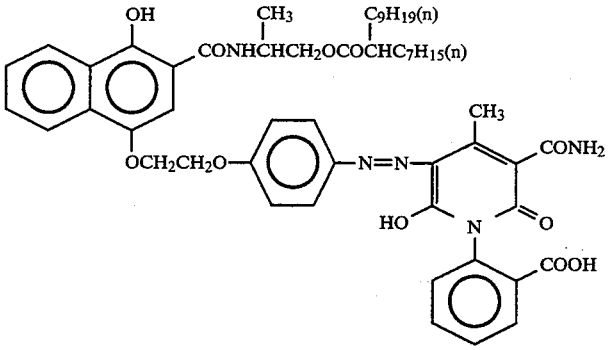
ExC-6
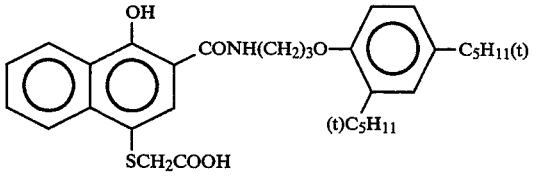
ExC-7
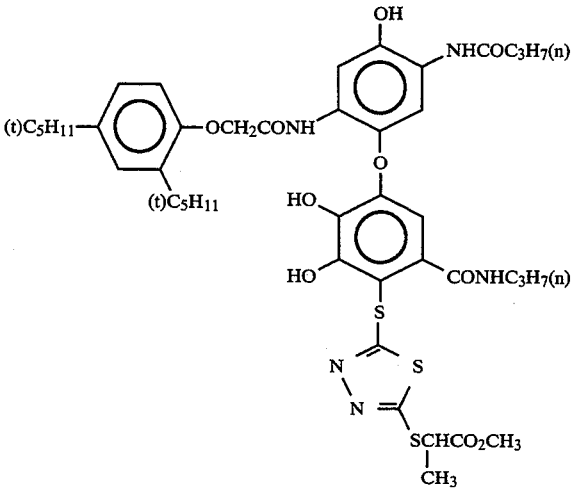
ExM-1
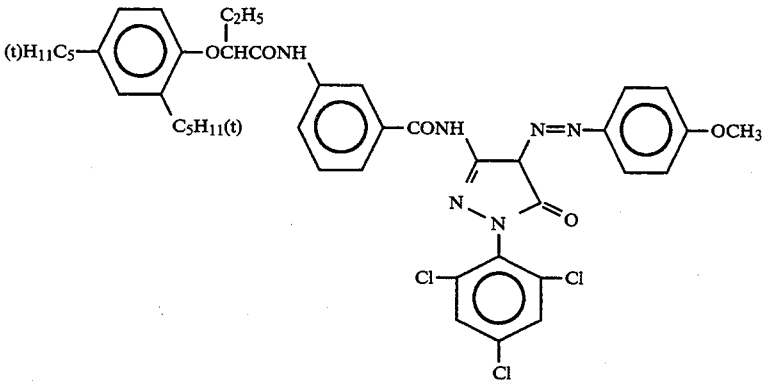

-continued
ExM-2
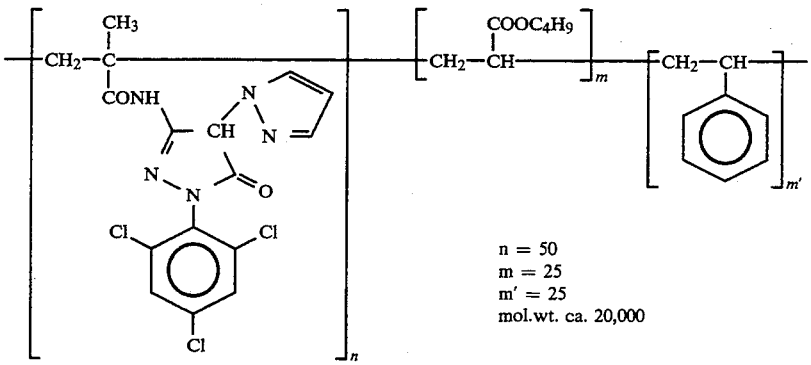
ExM-3
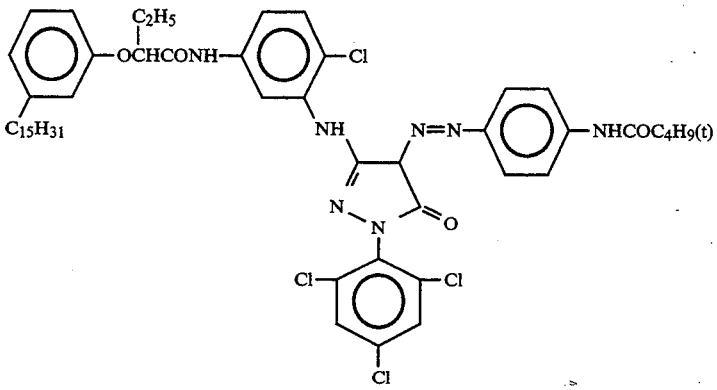
ExY-1
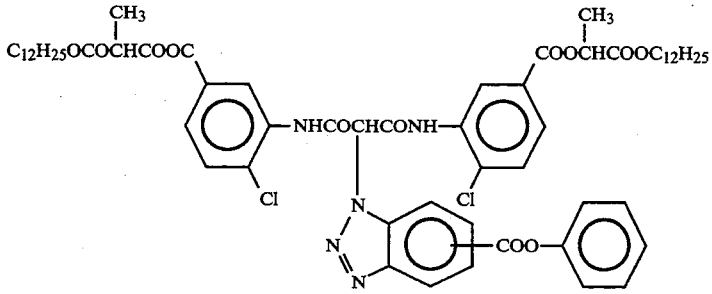
ExY-2
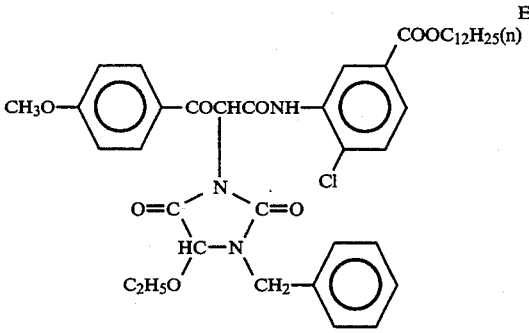
ExF-1
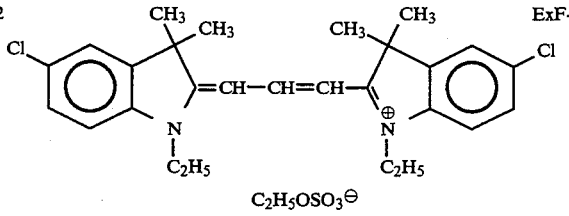
Cpd-1
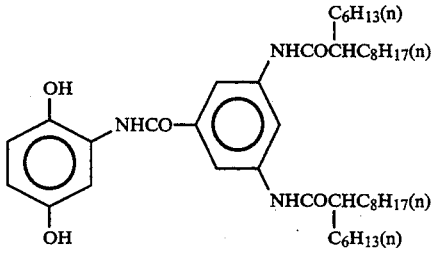
UV-1
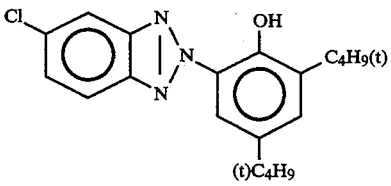

-continued
UV-2
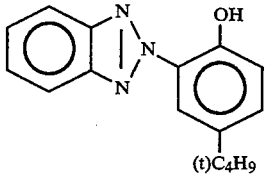
UV-3
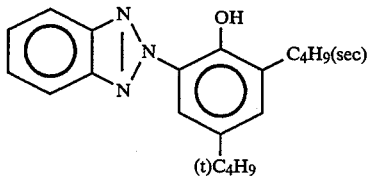
UV-4
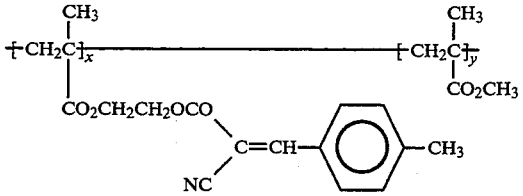
x:y = 70:30(wt %)
UV-5
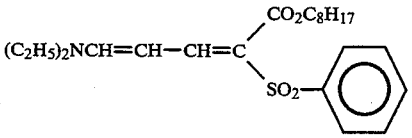
Tricresyl Phosphate HBS-1
Di-n-butyl Phthalate HBS-2
HBS-3
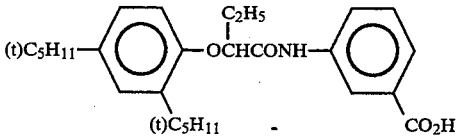
ExS-1
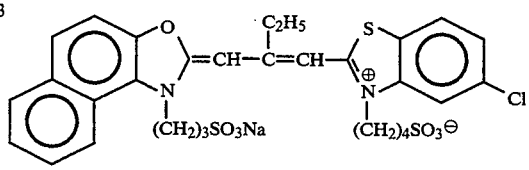
ExS-2
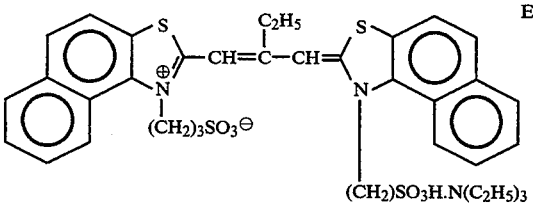
ExS-3
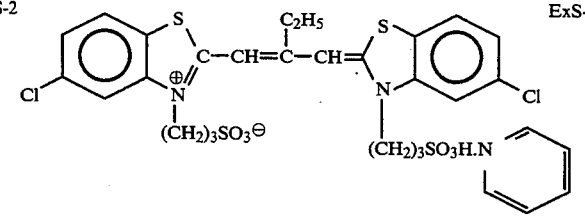
ExS-4
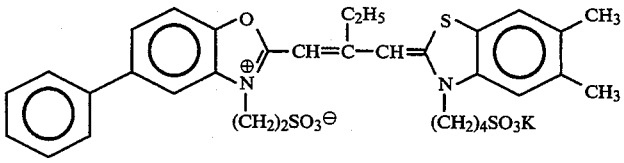
ExS-5
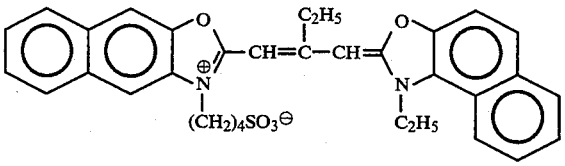
ExS-6
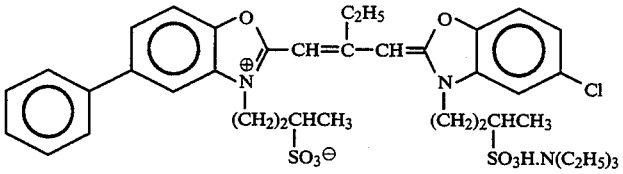
ExS-7
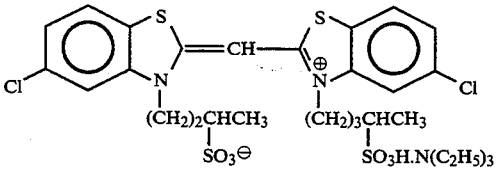
S-1
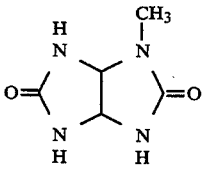

$CH_2{=}CH{-}SO_2{-}CH_2{-}CONH{-}CH_2$
$CH_2{=}CH{-}SO_2{-}CH_2{-}CONH{-}CH_2$
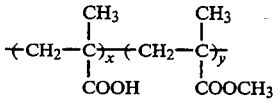
x/y = 40/60 (wt %)
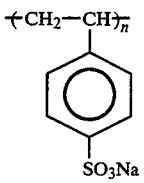
(mol. wt. ca. 750,000)
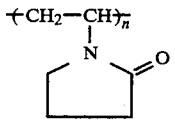
(mol. wt. ca. 10,000)
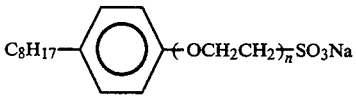
n = 2~4
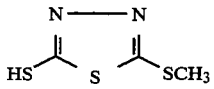
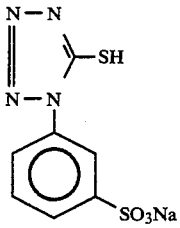
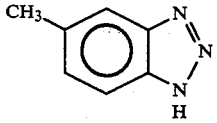
H-1
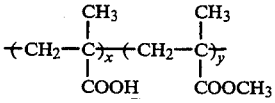
x/y = 10/90 (wt %)
B-2
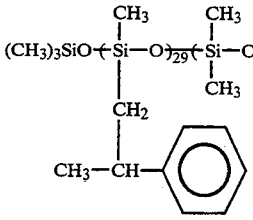
B-4
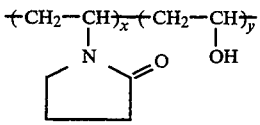
x/y = 70/30 (wt %)
B-5
$C_8F_{17}SO_2NHCH_2CH_2CH_2OCH_2CH_2\overset{\oplus}{N}(CH_3)_3$
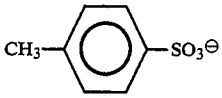
W-2
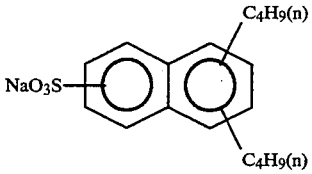
F-1
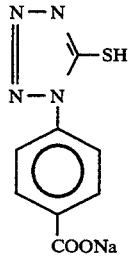
F-3
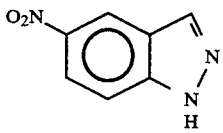
F-5
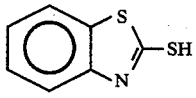
B-1
B-3
B-5
W-1
W-3
F-2
F-4
F-6

-continued

F-7

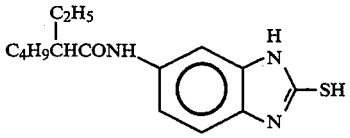

F-8

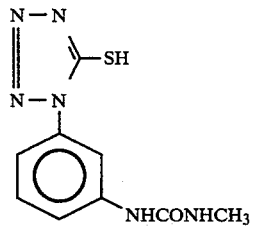

F-9

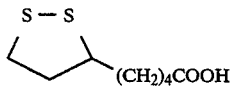

F-10

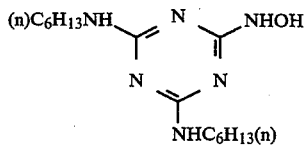

F-11

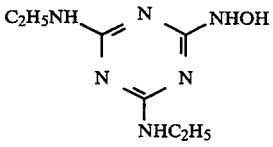

F-12

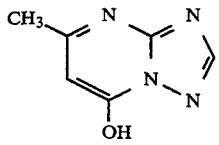

F-13

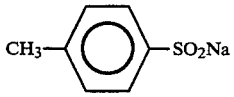

F-14

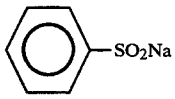

F-15

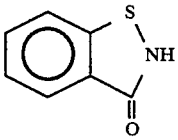

F-16

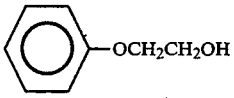

F-17

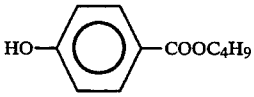

Sample 102 was prepared in the same manner as in preparation of the preceding sample 101, except that the comparative coupler (a) in the ninth layer was replaced by the same molar amount of comparative coupler (b). Samples 103 to 107 were prepared also in the same manner as in preparation of the preceding sample 101, except that the comparative coupler (a) in the ninth layer was replaced by the magenta coupler of the present invention as indicated in Table 4 below. Samples 108 to 114 were prepared in the same manner as in preparation of the preceding samples 101 to 107, except that the coupler ExM-2 in the seventh layer and the eighth layer was replaced by the comparative coupler or the magenta coupler of the present invention as indicated in Table 4.

The thus prepared samples 101 to 114 were wedgewise exposed with a white light for 1/100 second and then subjected to color development in accordance with the process mentioned below.

| Color Development Process: | | |
|---|---|---|
| Step | Time | Temperature |
| Color Development | 3 min 15 sec | 38° C. |
| Bleaching | 1 min 00 sec | 38° C. |
| Bleach-fixation | 3 min 15 sec | 38° C. |
| Rinsing (1) | 40 sec | 35° C. |
| Rinsing (2) | 1 min 00 sec | 35° C. |
| Stabilization | 40 sec | 38° C. |

-continued

| Color Development Process: | | |
|---|---|---|
| Step | Time | Temperature |
| Drying | 2 min 15 sec | 55° C. |

Compositions of the processing solutions used above are mentioned below.

| | |
|---|---|
| Color Developer: | |
| Diethylenetriaminepentaacetic Acid | 1.0 g |
| 1-Hydroxyethylidene-1,1-diphosphonic Acid | 3.0 g |
| Sodium Sulfite | 4.0 g |
| Potassium Carbonate | 30.0 g |
| Potassium Bromide | 1.4 g |
| Potassium Iodide | 1.5 mg |
| Hydroxylamine Sulfate | 2.4 g |
| 4-[N-ethyl-N-β-hydroxyethylaminol-2-methylaniline Sulfate | 4.5 g |
| Water to make | 1.0 liter |
| pH | 10.05 |
| Bleaching Solution: | |
| Ammonium Ethylenediaminetetraacetato/ Ferric Complex Dehydrate | 120.0 g |
| Disodium Ethylenediaminetetraacetate | 10.0 g |
| Ammonium Bromide | 100.0 g |
| Ammonium Nitrate | 10.0 g |
| Bleaching Accelerator $(CH_3)_2N—CH_2—CH_2—S—S—CH_2—$ | 0.005 mol |

-continued

| | |
|---|---|
| $CH_2$—$N(CH_3)_2.2HCl$ | |
| Aqueous Ammonia (27%) | 15.0 ml |
| Water to make | 1.0 liter |
| pH | 6.3 |
| Bleach-Fixing Solution: | |
| Ammonium Ethylenediaminetetraacetato/ Ferric Complex Dehydrate | 50.0 g |
| Disodium Ethylenediaminetetraacetate | 5.0 g |
| Sodium Sulfite | 12.0 g |
| Ammonium Thiosulfate Aqueous Solution (700 g/liter) | 240.0 ml |
| Aqueous Ammonia (27%) | 6.0 ml |
| Water to make | 1.0 liter |
| pH | 7.2 |

Rinsing Solution:

A city water was passed through a mixed bed type column as filled with an H-type strong acidic cation-exchange resin (Amberlite IR-120B, produced by Rhom & Haas Co.) and an OH-type basic anion-exchange resin (Amberlite IR-400, produced by Rhom & Haas Co.) so that both the calcium ion concentration and the magnesium ion concentration in the water were reduced to 3 mg/liter, individually. Next, 20 ml/liter of sodium dichloroisocyanurate and 0.15 g/liter of sodium sulfate were added to the resulting water, which had a pH value falling within the range of from 6.5 to 7.5. This was used as the rinsing water.

| Stabilizing Solution: | |
|---|---|
| Sodium P-toluenesulfinate | 0.03 g |
| Polyoxyethylene P-monononylphenyl Ether (mean polymerization degree 10) | 0.2 g |
| Disodium Ethylenediaminetetraacetate | 0.05 g |
| 1,2,4-Triazole | 1.3 g |
| 1,4-Bis(1,2,4-triazol-1-ylmethyl)-piperazine | 0.75 g |
| Water to make | 1.0 liter |

-continued

| Stabilizing Solution: | |
|---|---|
| pH | 8.5 |

The density of each of the processed samples was measured through a green filter, and the reciprocal of the exposure amount to give a density of (minimum density+0.2) was obtained. The obtained value was represented as a relative sensitivity of each sample on the basis of the control sensitivity (100) of sample 101.

Apart from the preceding processed samples, two other groups of samples 101 to 114 were prepared and these were wedgewise exposed to a white light for 1/100 second. One group of the samples was stored under the condition of 50° C. and 30% RH for 10 days, while the other group of them was stored under the condition of 5° C. and 55% RH for 10 days. Then, these two groups of samples were processed at the same time in accordance with the process mentioned above. The density of each of the processed samples was measured through a green filter.

The value of the exposure amount giving a density of (minimum density+0.2) for each of the samples of the latter group (stored at 5° C. and 55% RH) was read out, and the logarithmic number of the reciprocal of the value was represented by $S^r_G$.

Also, the value of the exposure amount giving a density of (minimum density+0.2) for each of the samples of the former group (stored at 50° C. and 30% RH) was read out, and the logarithmic number of the reciprocal of the value was represented by $S^s_G$.

The difference between them ($\Delta S = S^s_G - S^r_G$) was used as a criterion for evaluating the latent image stability.

The results obtained are shown in Table 4 below.

TABLE 4

| Sample No. | Coupler in 7th Layer | Coupler in 8th Layer | Coupler in 9th Layer | Relative Sensitivity | Latent Image Stability (ΔS) | Remarks |
|---|---|---|---|---|---|---|
| 101 | ExM-2 | ExM-2 | Comparative coupler (a) | 100 | −0.04 | Comparative Sample |
| 102 | ExM-2 | ExM-2 | Comparative coupler (b) | 89 | −0.06 | Comparative Sample |
| 103 | ExM-2 | ExM-2 | M-1 | 107 | +0.01 | Sample of the Invention |
| 104 | ExM-2 | ExM-2 | M-6 | 105 | +/−0.0 | Sample of the Invention |
| 105 | ExM-2 | ExM-2 | M-13 | 105 | −0.01 | Sample of the Invention |
| 106 | ExM-2 | ExM-2 | M-19 | 107 | +0.02 | Sample of the Invention |
| 107 | ExM-2 | ExM-2 | M-11 | 105 | +0.01 | Sample of the Invention |
| 108 | Comparative coupler (c) | Comparative coupler (c) | Comparative coupler (c) | 85 | −0.04 | Comparative Sample |
| 109 | M-9 | M-9 | M-1 | 107 | +0.01 | Sample of the Invention |
| 110 | M-24 | M-24 | M-11 | 105 | +0.01 | Sample of the Invention |
| 111 | Comparative coupler (d) | Comparative coupler (d) | Comparative coupler (d) | 100 | −0.06 | Comparative Sample |
| 112 | Comparative coupler (e) | Comparative coupler (e) | Comparative coupler (e) | 95 | −0.03 | Comparative Sample |
| 113 | Comparative coupler (f) | Comparative coupler (f) | Comparative coupler (f) | 92 | −0.05 | Comparative Sample |
| 114 | Comparative coupler (g) | Comparative coupler (g) | Comparative coupler (g) | 85 | −0.06 | Comparative Sample |

Comparative couplers used above are mentioned and shown below.

Comparative coupler (a) (described in JP-A-61-65246):

-continued
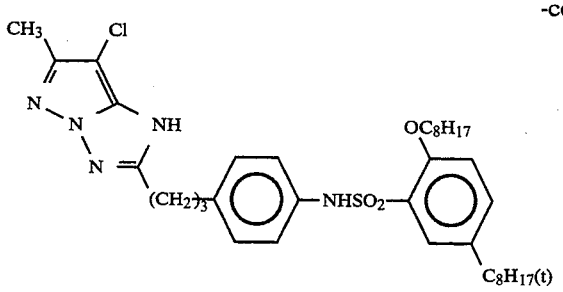
Comparative coupler (b) (described in JP-A-61-65248):
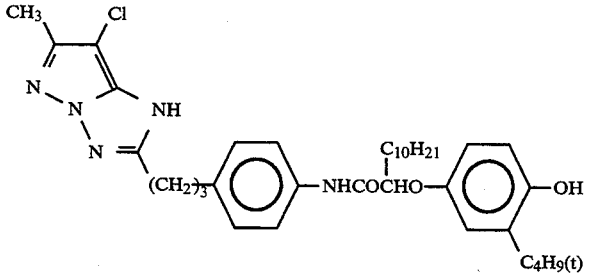
Comparative coupler (c) (described in JP-A-62-209460):
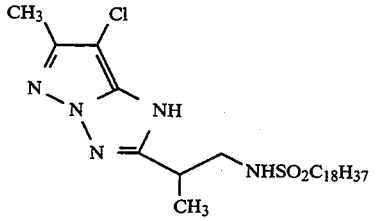
Comparative coupler (d) (described in JP-A-62-125349):
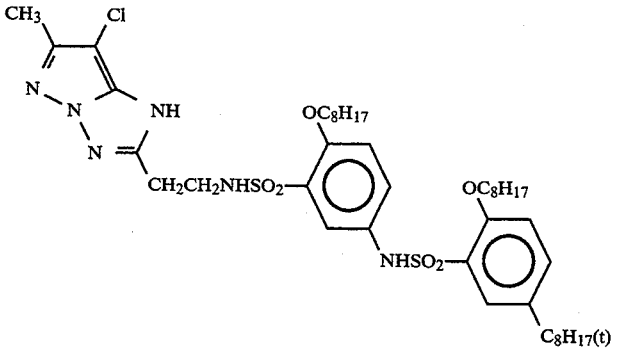
Comparative coupler (e) (described in JP-A-62-79451 and U.S. Pat. No. 4,900,655):
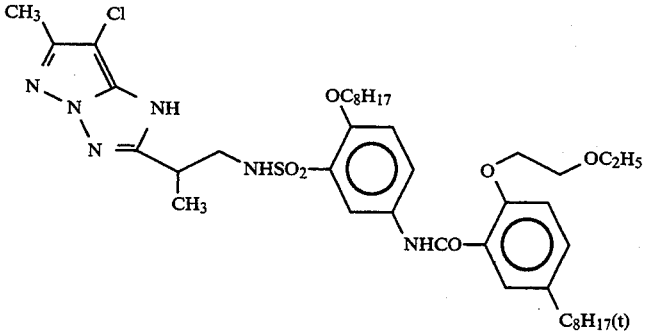
Comparative coupler (f) (described in JP-A-1-106055)

-continued

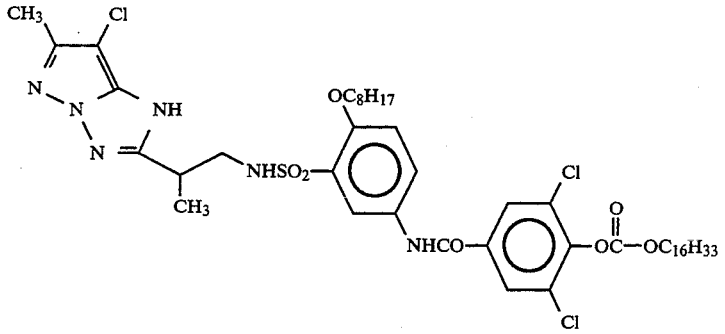

Comparative coupler (g) (described in JP-A-2-2339)

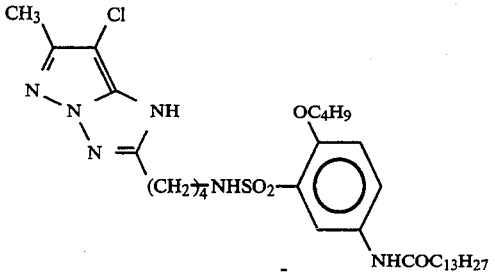

From the results in Table 4 above, it is understood that the samples of the present invention all have elevated sensitivity and elevated latent image storability. The reason may be that conventional couplers (such as the comparative couplers used above) interact with the silver halide emulsions which constitute the photographic materials—during processing or during storage of the materials after exposure—to cause a retardation in the developability of the materials. The couplers of formula (I) of the present invention are free from such unfavorable interactions and therefore do not cause a reduction in their color forming capacity during processing or in stored photographic materials.

EXAMPLE 2

Sample No. 214 (multi-layer color paper) of Example 2 of European Patent No. 355,660A2 (corresponding JP-A-2-139544 and U.S. Ser. No. 07/393,747) is modified in such a way that the bisphenol compound (III-23) is replaced by compound (III-10), that the yellow coupler (ExY), the cyan coupler (ExC), the image stabilizer (Cpd-8), the solvent (Solv-6) and the oxonole dyes are replaced by the following compounds, respectively, and that the antiseptics (bactericidal and fungicidal component) mentioned below are incorporated therein.

(ExY) Yellow Coupler:

1:1 (by mol) mixture of :

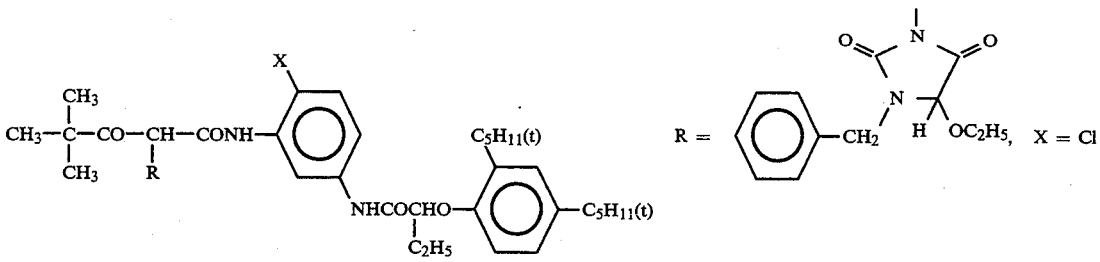

and

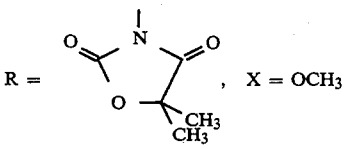

(ExC) Cyan Coupler:

1:1:1 (by mol) mixture of:

-continued
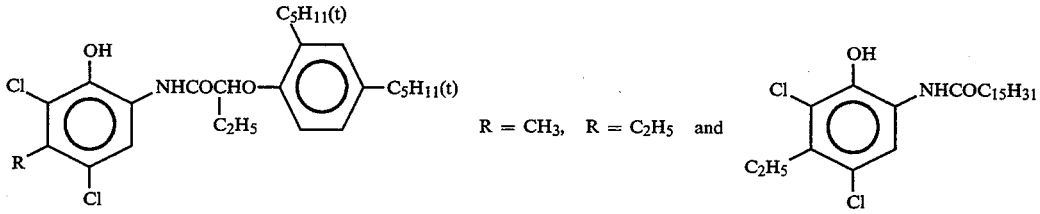
(Cpd-8) Color Image Stabilizer:
1:1 (by mol) mixture of:
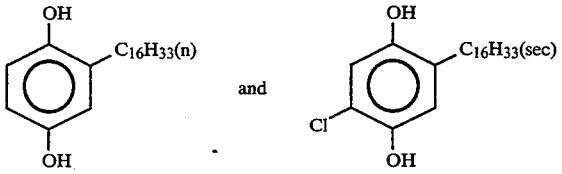
(Cpd-10) Antiseptic:
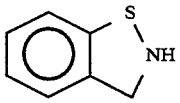
(25.0 mg/$m^2$)
(Cpd-11) Antiseptic:
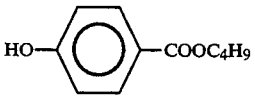
(50.0 mg/$m^2$)
(Solv-6) Solvent:
9:1 (by weight) mixture of:
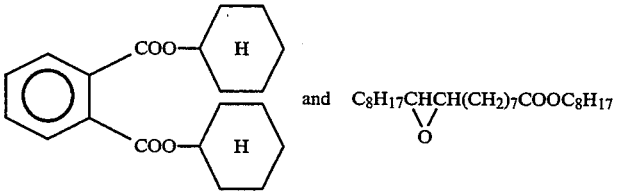
Oxonole Dyes:
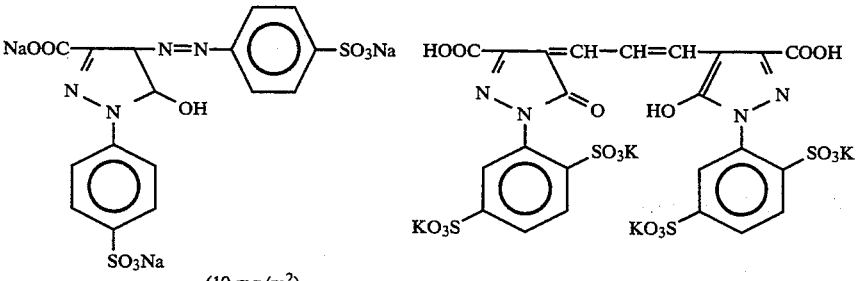
(10 mg/$m^2$) (10 mg/$m^2$)

-continued

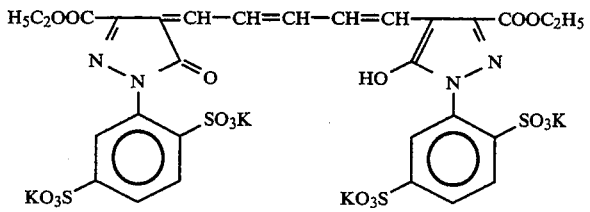

(40 mg/m²)

and

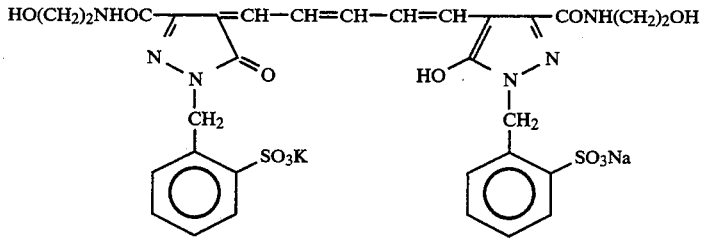

(20 mg/m²)

The modified sample is exposed in the same manner as in Example 2 of EP Patent No. 355,660A2 specification, and is stored under the condition of 50° C. and 30% RH for 2 days, and is processed in the same manner as in Example 2 of the same.

The variation of the photographic properties of the sample before and after storage under the preceding condition is determined and is favorably little, like the samples of the present as described in the preceding Example 1.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material having at least one light-sensitive silver halide emulsion layer on a support, the photographic material containing at least one coupler of formula (I):

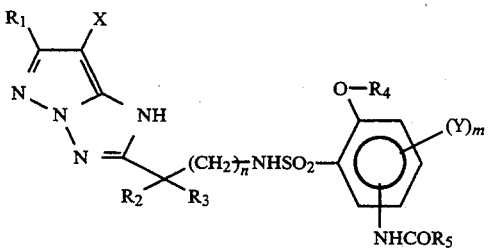

(I)

wherein:

$R_1$ is a methyl or ethyl group;

$R_2$ and $R_3$ each represent a hydrogen atom, an optionally substituted alkyl group or an optionally substituted aryl group, provided that both $R_2$ and $R_3$ are not hydrogen atoms at the same time and at least one of $R_2$ and $R_3$ is a methyl group;

$R_4$ is represented by the formula $-(CH_2)_2-(A)-R_6$ wherein A is an oxygen atom and $R_6$ is a methyl group, an ethyl group, a propyl group, an isopropyl group, a butyl group or a phenyl group;

$R_5$ is an optionally substituted alkyl group having 14 to 50 carbon atoms in total;

X is a halogen atom selected from the group consisting of fluorine, chlorine and bromine, or, X is an aryloxy group selected from the group consisting of a phenoxy group, a 4-methylphenoxy group, a 4-methoxycarbonylphenoxy group, a 4-t-octylphenoxy group and a 4-cyanophenoxy group;

Y is a halogen atom, a phenyl group, a naphthyl group, a p-tolyl group, a 4-pyridyl group, a 2-furyl group, a methoxy group, an ethoxy group, a butoxy group, a dodecyloxy group, an isopropyloxy group, a t-butoxy group, a phenoxy group, a 2,4-di-t-amylphenoxy group, a p-t-octylphenoxy group, a 2-methoxyphenoxy group, a methylthio group, an ethylthio group, an octylthio group, a 2-ethylhexylthio group, a dodecylthio group, a phenylthio group, a 2-butoxy-5-t-octylphenylthio group, an acetyl group, a pivaloyl group, a benzoyl group, an N,N-diethylcarbamoyl group, an N-butylcarbamoyl group, an N-phenylcarbamoyl group, an acetamido group, a pivaloylamido group, a tetradecanamido group, a benzamido group, an N,N-diethylureido group, an N-phenylureido group, a methanesulfonamido group, a p-toluenesulfonamido group, a methoxycarbonyl group, an ethoxycarbonyl group, a butoxycarbonyl group, an isopropyloxycarbonyl group, a dodecyloxycarbonyl group or a cyano group;

n represents 0 or 1; and m represents an integer of from 0 to 3.

2. The silver halide color photographic material as recited in claim 1, wherein $R_2$ and $R_3$ each is (1) a hydrogen atom, (2) a straight or branched alkyl group optionally substituted by a halogen atom, an aryl group, a heterocyclic group, an alkoxy group, an aryloxy group, an alkylthio group, an arylthio group, an acyl group, a carbamoyl group, an amido group, an ureido group, a sulfonamido group, an alkoxycarbonyl group or a cyano group, or (3) an aryl group optionally substituted by a halogen atom, an aryl group, a heterocyclic group, an alkoxy group, an aryloxy group, an alkylthio group, an arylthio group, an acyl group, a carbamoyl group, an amido group, a ureido group, a sulfonamido group, an alkoxycarbonyl group or a cyano group.

3. The silver halide color photographic material as recited in claim 1, wherein $R_2$ and $R_3$ each is (1) a hydrogen atom, (2) an alkyl group optionally substituted by a halogen atom, phenyl, naphthyl, p-tolyl, 4-pyridyl, 2-furyl, methoxy, ethoxy, butoxy, dodecyloxy, isopropyloxy, t-butoxy, phenoxy, 2,4-di-t-amylphenoxy, p-t-octylphenoxy, 2-methoxy-phenoxy, methylthio, ethylthio, octylthio, 2-ethylhexylthio, dodecylthio, phenylthio, 2-butoxy-5-t-octylphenylthio, acetyl, pivaloyl, benzoyl, N,N-diethylcarbamoyl, N-butylcarbamoyl, N-phenylcarbamoyl, acetamido, pivaloylamido, tetradecanamido, benzamido, N, N-diethylureido, N-phenylureido, methanesulfonamido, p-toluenesulfonamido, methoxycarbonyl, ethoxycarbonyl, butoxycarbonyl, isopropyloxycarbonyl, dodecyloxycarbonyl or a cyano group, or (3) a phenyl group optionally substituted by a halogen atom, phenyl, naphthyl, p-tolyl, 4-pyridyl, 2-furyl, methoxy, ethoxy, butoxy, dodecyloxy, isopropyloxy, t-butoxy, phenoxy, 2,4-di-t-amylphenoxy, p-t-octylphenoxy, 2-methoxy-phenoxy, methylthio, ethylthio, octylthio, 2-ethylhexylthio, dodecylthio, phenylthio, 2-butoxy-5-octylphenylthio, acetyl, pivaloyl, benzoyl, N,N-diethyl-carbamoyl, N-butylcarbamoyl, N-phenylcarbamoyl, acetamido, pivaloylamido, tetradecanamido, benzamido, N,N-diethylureido, N-phenylureido, methanesulfonamido, p-toluenesulfonamido, methoxy-carbonyl, ethoxycarbonyl, butoxycarbonyl, isopropyloxycarbonyl or a cyano group.

4. The silver halide color photographic material as recited in claim 1, wherein $R_5$ is a straight or branched alkyl group optionally substituted by a halogen atom, a hydroxyl group, a cyano group, an aryl group, an alkoxy group, an aryloxy group, an alkylthio group, an arylthio group, an acyl group, an amido group, a sulfonamido group, a carbamoyl group, a sulfamoyl group, an ureido group, an urethane group, an alkoxycarbonyl group or a sulfonyl group, wherein $R_5$ contains 14 to 50 carbon atoms in total.

5. The silver halide color photographic material as recited in claim 1, wherein $R_5$ is a straight or branched alkyl group optionally substituted by a halogen atom, a hydroxyl group, a cyano group, phenyl, naphthyl, methoxy, ethoxy, propyloxy, butyloxy, 2-ethylhexyloxy, hexyloxy, octyloxy, dodecyloxy, hexadecyloxy, ethoxyethoxy, phenoxyethoxy, 4-methoxyphenoxyethoxy, phenoxy, 2,4-di-t-amylphenoxy, 4-methylphenoxy, 4-ethoxycarbonylphenoxy, 4-methoxyphenoxy, 4-ethoxyphenoxy, methylthio, ethylthio, propylthio, butylthio, octylthio, dodecylthio, hexadecylthio, phenylthio, 2-pivaloylamidophenylthio, 2-butoxy-5-t-octylphenylthio, 4-dodecyloxyphenylthio, acetyl, benzoyl, acetamido, butanamido, tetradecanamido, hexadecanamido, benzamido, 2-butoxybenzamido, 2-hexadecyloxybenzamido, 4-dodecyloxybenzamido, 4-t-butylbenzamido, α-(2,4-di-t-amylphenoxy)butanamido, methanesulfonamido, ethanesulfonamido, octanesulfonamido, hexadecanesulfonamido, benzenesulfonamido, 4-methylbenzenesulfonamido, 4-dodecyloxybenzenesulfonamido, 2-octyloxy-5-t-octylbenzenesulfonamido, N-methylcarbamoyl, N-ethylcarbamoyl, N-butylcarbamoyl, N-dodecylcarbamoyl, N-cyclohexylcarbamoyl, N,N-diethylcarbamoyl, N,N-diisopropylcarbamoyl, N,N-dibutylcarbamoyl, N-octadecyl-N-methylcarbamoyl, N-phenylcarbamoyl, N-ethylsulfamoyl, N-butylsulfamoyl, N-hexylsulfamoyl, N-dodecylsulfamoyl, N-cyclohexylsulfamoyl, N,N-diethylsulfamoyl, N,N-dibutylsulfamoyl, N-ethylureido, N-butylureido, N-hexadecylureido, N-phenylureido, N,N-dimethylureido, N,N-dibutylureido, methylurethane, ethylurethane, propylurethane, butylurethane, dodecylurethane, phenylurethane, methoxycarbonyl, ethoxycarbonyl, propyloxycarbonyl, isopropyloxycarbonyl, butoxycarbonyl, dodecyloxycarbonyl, hexadecyloxycarbonyl, methylsulfonyl, ethylsolfonyl, butylsulfonyl, dodecylsulfonyl, hexadecylsulfonyl, or octadecylsulfonyl, wherein $R_5$ contains 14 to 50 carbon atoms in total.

6. The silver halide color photographic material as recited in claim 1, wherein X is a halogen atom selected from the group consisting of fluorine, chlorine and bromine.

7. The silver halide color photographic material as recited in claim 1, wherein X is an aryloxy group selected from the group consisting of a phenoxy group, a 4-methylphenoxy group, a 4-methoxycarbonylphenoxy group, a 4-t-octylphenoxy group and a 4-cyanophenoxy group.

* * * * *